US011302232B2

(12) United States Patent
Ryu et al.

(10) Patent No.: US 11,302,232 B2
(45) Date of Patent: Apr. 12, 2022

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventors: Fukukai Ryu, Matsumoto (JP); Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/149,825

(22) Filed: Jan. 15, 2021

(65) Prior Publication Data

US 2021/0225241 A1 Jul. 22, 2021

(30) Foreign Application Priority Data

Jan. 16, 2020 (JP) ..... JP2020-005190

(51) Int. Cl.
*G09G 3/20* (2006.01)

(52) U.S. Cl.
CPC ..... *G09G 3/20* (2013.01); *G09G 2310/0297* (2013.01); *G09G 2320/0233* (2013.01)

(58) Field of Classification Search
CPC ..... G09G 3/20; G09G 2310/0297; G09G 2320/0233
See application file for complete search history.

(56) References Cited

U.S. PATENT DOCUMENTS

| | | | | |
|---|---|---|---|---|
| 2010/0194718 | A1 | 8/2010 | Morita | |
| 2010/0194734 | A1 | 8/2010 | Morita | |
| 2010/0194738 | A1 | 8/2010 | Morita | |
| 2020/0082788 | A1* | 3/2020 | Qiu | G09G 5/10 |
| 2020/0083260 | A1* | 3/2020 | Miyake | G09G 3/3266 |
| 2020/0090602 | A1* | 3/2020 | Li | G09G 5/02 |
| 2021/0012696 | A1* | 1/2021 | Qiu | G09G 3/20 |
| 2021/0035521 | A1* | 2/2021 | Qiu | G09G 3/2003 |

FOREIGN PATENT DOCUMENTS

| | | | |
|---|---|---|---|
| JP | 2003-058119 | A | 2/2003 |
| JP | 2010-181503 | A | 8/2010 |
| JP | 2010-181506 | A | 8/2010 |
| JP | 2010-181516 | A | 8/2010 |
| JP | 2013-050476 | A | 3/2013 |

* cited by examiner

*Primary Examiner* — Sejoon Ahn
(74) *Attorney, Agent, or Firm* — Oliff PLC

(57) ABSTRACT

A circuit device configured to drive an electro-optical panel including a demultiplexer provided between a first to n-th data lines, n being an integer of three or greater, and a data signal supply line, includes a data line driving circuit configured to output a data signal to the data signal supply line, and a processing circuit configured to set a selection order, by the demultiplexer, of the first to n-th data lines. When an i-th data line, i being an integer of 1 to n, is selected j-th, j being an integer of 1 to n, in the first selection order, the processing circuit sets a second selection order using random number information so as to prohibit the i-th data line from being selected j-th in the second selection order.

15 Claims, 16 Drawing Sheets

| DL1 | DL2 | DL3 | DL4 | DL5 | DL6 | DL7 | DL8 | |
|---|---|---|---|---|---|---|---|---|
| 1 | 2 | 3 | 4 | 5 | 6 | 7 | 8 | N-th LINE |
| 4 | 2 | 6 | 8 | 7 | 1 | 3 | 5 | (N + 1)-th LINE |
| 6 | 2 | 3 | 5 | 4 | 8 | 7 | 1 | (N + 2)-th LINE |

FIG. 5

| DL1 | DL2 | DL3 | DL4 | DL5 | DL6 | DL7 | DL8 | |
|---|---|---|---|---|---|---|---|---|
| 1 | 2 | 3 | 4 | 5 | 6 | 7 | 8 | N-th LINE |
| 2 | 4 | 6 | 8 | 7 | 1 | 3 | 5 | (N + 1)-th LINE |
| 6 | 2 | 3 | 5 | 4 | 8 | 7 | 1 | (N + 2)-th LINE |

FIG. 6

$$T=\begin{pmatrix} X & X & 0 & 0 & 1 & 0 & 0 & X \\ X & X & X & \sigma_{24} & 0 & \sigma_{26} & \sigma_{27} & \sigma_{28} \\ \sigma_{31} & X & X & X & 0 & \sigma_{36} & \sigma_{37} & \sigma_{38} \\ \sigma_{41} & \sigma_{42} & X & X & X & \sigma_{46} & \sigma_{47} & \sigma_{48} \\ \sigma_{51} & \sigma_{52} & \sigma_{53} & X & X & X & \sigma_{57} & \sigma_{58} \\ \sigma_{61} & \sigma_{62} & \sigma_{63} & \sigma_{64} & X & X & X & \sigma_{68} \\ \sigma_{71} & \sigma_{72} & \sigma_{73} & \sigma_{74} & 0 & X & X & X \\ X & \sigma_{82} & \sigma_{83} & \sigma_{84} & 0 & \sigma_{86} & X & X \end{pmatrix}$$

FIG. 10

CIRCUIT DEVICE, ELECTRO-OPTICAL DEVICE, AND ELECTRONIC APPARATUS

The present application is based on, and claims priority from JP Application Serial Number 2020-005190, filed Jan. 16, 2020, the disclosure of which is hereby incorporated by reference herein in its entirety.

BACKGROUND

1. Technical Field

The present disclosure relates to a circuit device, an electro-optical device, and an electronic apparatus.

2. Related Art

In recent years, high-definition image technology such as high-definition image has become popular, and display devices such as liquid crystal projectors become higher-definition and multi-gradation. Therefore, a display driver that employs a multiplex drive system is used. In the multiplex drive system, it is known that display irregularity occurs due to the drive order, that is, the selection order of the data lines.

JP-A-2010-181516 discloses a method in which any of a plurality of rotation patterns is used to diffuse display irregularities on a display surface to make the display irregularities inconspicuous. JP-A-2003-58119 discloses a method for randomly switching the selection order using random numbers.

In the method disclosed in JP-A-2010-181516, any of the plurality of predetermined rotation patterns is selected according to some rule. Thus, display irregularity according to the rule may be visible. In the method disclosed in JP-A-2003-58119, since the selection order is determined using the random numbers, the display irregularities may be recognized by gathering at a certain position on the screen.

SUMMARY

One aspect of the present disclosure relates to a circuit device configured to drive an electro-optical panel including a demultiplexer provided between a first to n-th data lines, n being an integer of three or greater, and a data signal supply line, includes a data line driving circuit configured to output a data signal to the data signal supply line, and a processing circuit configured to set a selection order, by the demultiplexer, of the first to n-th data lines, in which when an i-th data line, i being an integer of 1 to n, is selected j-th, j being an integer of 1 to n, in a first selection order that is a current selection order of the first to n-th data lines, in a second selection order that is a next selection order of the first to n-th data lines, the processing circuit sets the second selection order using random number information so as to prohibit the i-th data line from being selected j-th.

Another aspect of the present disclosure relates to an electro-optical device including the circuit device described above and the electro-optical panel.

Still another aspect of the present disclosure relates to an electronic apparatus including the circuit device described above.

BRIEF DESCRIPTION OF THE DRAWINGS

FIG. 5 is an example of a prohibited selection order.

FIG. 6 is an example of a prohibited selection order.

FIG. 10 is a diagram illustrating selection of candidate components and updating of prohibition components.

DESCRIPTION OF EXEMPLARY EMBODIMENTS

The exemplary embodiment will be described below. Note that the exemplary embodiment described hereinafter is not intended to unjustly limit the content as set forth in the claims. In addition, all of the configurations described in the exemplary embodiment are not necessarily essential constituent requirements.

1. SYSTEM CONFIGURATION EXAMPLE

Figure 1:
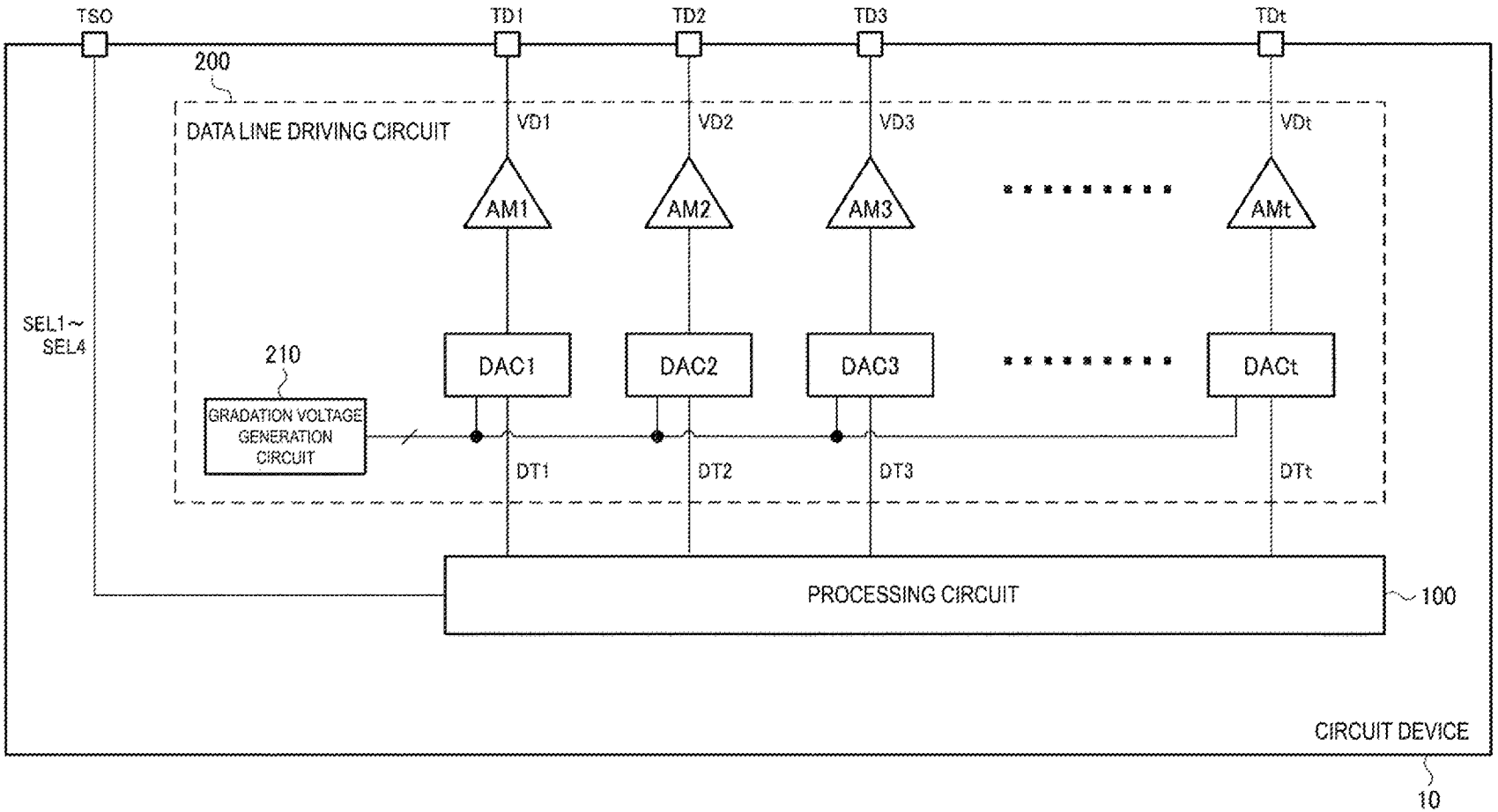
FIG. 1 is a configuration example of a circuit device.
Figure 2:
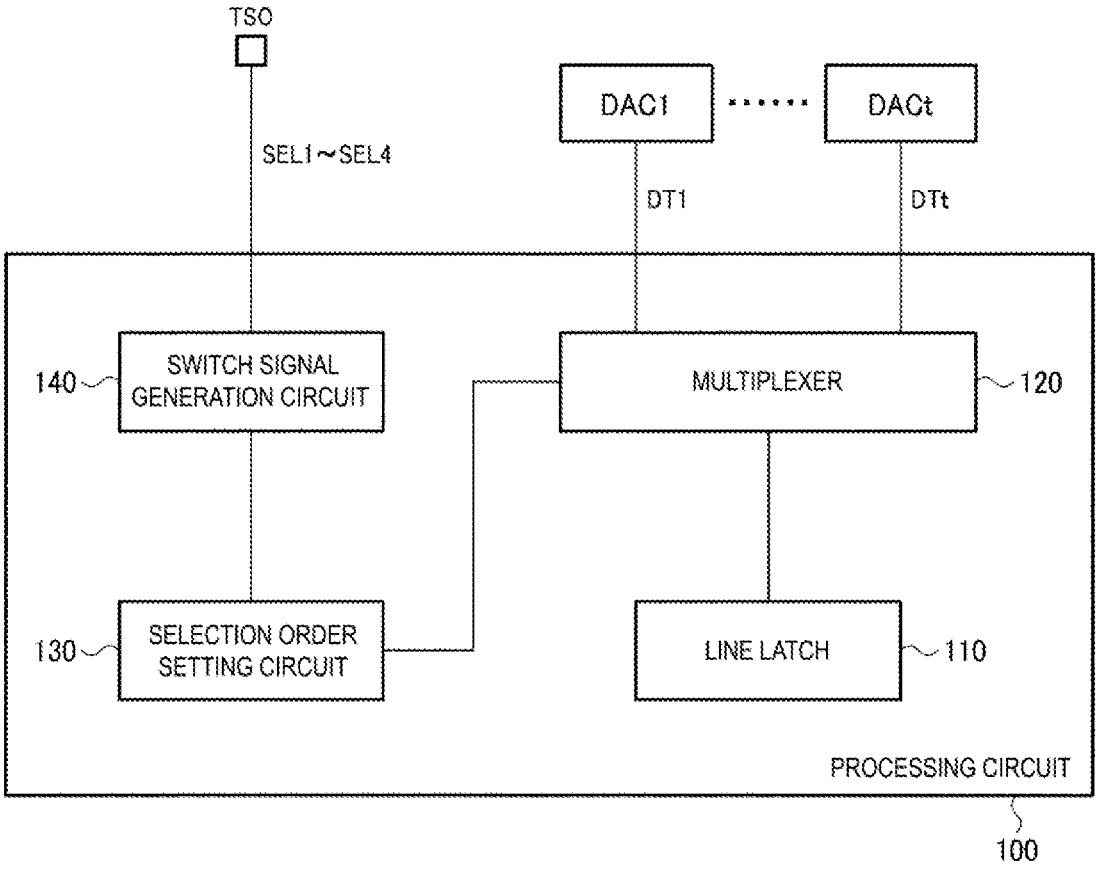
FIG. 2 is a configuration example of a processing circuit.

FIGS. 1 and 2 are configuration examples of a circuit device 10 of an exemplary embodiment. The circuit device 10 of the exemplary embodiment is specifically a display driver configured to drive an electro-optical panel 20 described later with reference to FIG. 3. Note that the circuit device 10 of the exemplary embodiment is not limited to the configuration in FIG. 1, and various modifications can be achieved by, for example, omitting a part of the components or adding another component. For example, the circuit device 10 may include a scanning line driving circuit 40 of the electro-optical panel 20 described later using FIG. 3. In addition, in FIGS. 1 to 3, a case will be described as an example where the circuit device 10 performs demultiplex drive in which the number of signals to be demultiplexed is four, but the number may be eight as described later, or may be another number of two or greater.

The circuit device 10 of FIG. 1 drives the electro-optical panel 20 by supplying a data voltage to the pixels of the electro-optical panel 20. The electro-optical panel 20 may be, for example, an active matrix liquid crystal display panel or an electro luminescence (EL) panel. The circuit device 10 is an integrated circuit device.

As illustrated in FIG. 1, the circuit device 10, which is the display driver, includes a processing circuit 100 and a data line driving circuit 200. The circuit device 10 may include data voltage output terminals TD1 to TDt, which are first to n-th data voltage output terminals, and an output terminal TSO. The data line driving circuit 200 includes amplifier circuits AM1 to AMt, D/A conversion circuits DAC1 to DACt, and a gradation voltage generation circuit 210. t is an integer equal to or greater than three.

The processing circuit 100 outputs display data DT1 to the D/A conversion circuit DAC1. Similarly, the processing circuit 100 outputs display data DT2 to DTt to the D/A conversion circuits DAC2 to DACt. Further, the processing circuit 100 controls each unit of the circuit device 10. For example, the processing circuit 100 performs timing control when the circuit device 10 drives the electro-optical panel 20. Further, the processing circuit 100 may set the gain of the amplifier circuits AM1 to AMt by outputting the gain adjustment data to the amplifier circuits AM1 to AMt. The processing circuit 100 is a logic circuit. The logic circuit includes logic elements and signal lines coupling the logic elements, and the function of the logic circuit is implemented by the logic elements and the signal lines. Alternatively, the processing circuit 100 may be a processor such as a digital signal processor (DSP). In this case, the function of the processing circuit 100 is implemented by the processor executing a program in which the function of the processing circuit 100 is described.

As illustrated in FIG. 2, the processing circuit 100 includes a line latch 110, a multiplexer 120, a selection order setting circuit 130, and a switch signal generation circuit 140. However, the processing circuit 100 is not limited to the configuration of FIG. 2, and various modifications can be implemented by, for example, omitting a part of the components or adding another component. For example, the processing circuit 100 of the exemplary embodiment corresponds to the selection order setting circuit 130 in a narrow sense, and the other configurations may be provided outside the processing circuit 100.

The selection order setting circuit 130 performs a process of determining a selection order of the data lines in the multiplex drive system. A specific process flow will be described later. The selection order setting circuit 130 outputs a multiplex control signal to the multiplexer 120 based on the determined selection order. The selection order setting circuit 130 also outputs a demultiplex control signal to the switch signal generation circuit 140 based on the determined selection order. The switch signal generation circuit 140 outputs demultiplex switch signals SEL1 to SEL4 based on the demultiplex control signal.

The line latch 110 latches the image data of one horizontal scanning unit in synchronization with a horizontal synchronization signal. The multiplexer 120 receives the image data corresponding to each data line from the line latch 110, time-division multiplexes the image data corresponding to four data lines, and outputs time-division multiplexed display data corresponding to each data signal supply line. The multiplexer 120 multiplexes image data based on, for example, the multiplex control signal from the selection order setting circuit 130.

The D/A conversion circuit DAC1 converts the display data DT1 to a voltage corresponding to the display data DT1. Specifically, the D/A conversion circuit DAC1 selects a gradation voltage corresponding to the display data DT1 from the plurality of gradation voltages generated by the gradation voltage generation circuit 210. Similarly, the D/A conversion circuits DAC2 to DACt convert the display data DT2 to DTt to voltages corresponding to the display data DT2 to DTt. Each of the D/A conversion circuits DAC1 to DACt is, for example, a selector constituted by a transistor switch.

The amplifier circuit AM1 inverts and amplifies the voltage which is outputted from the D/A conversion circuit DAC1, and outputs the result to the data voltage output terminal TD1 as the data voltage VD1. Similarly, the amplifier circuits AM2 to AMt invert and amplify the voltage which are outputted from the D/A conversion circuits DAC2 to DACt, and output the results as the data voltages VD2 to VDt to the data voltage output terminals TD2 to TDt.

The data voltage output terminals TD1 to TDt are pads formed on a semiconductor substrate of an integrated circuit device or a terminal provided in a package of an integrated circuit device. The data voltage output terminals TD1 to TDt are arranged along the long side direction of the circuit device 10, which is the display driver. The data voltage output terminals TD1 to TDt are coupled to the data voltage input terminals TI1 to TIt of the electro-optical panel 20 via wiring, cables, or the like on the circuit board.

Figure 3:
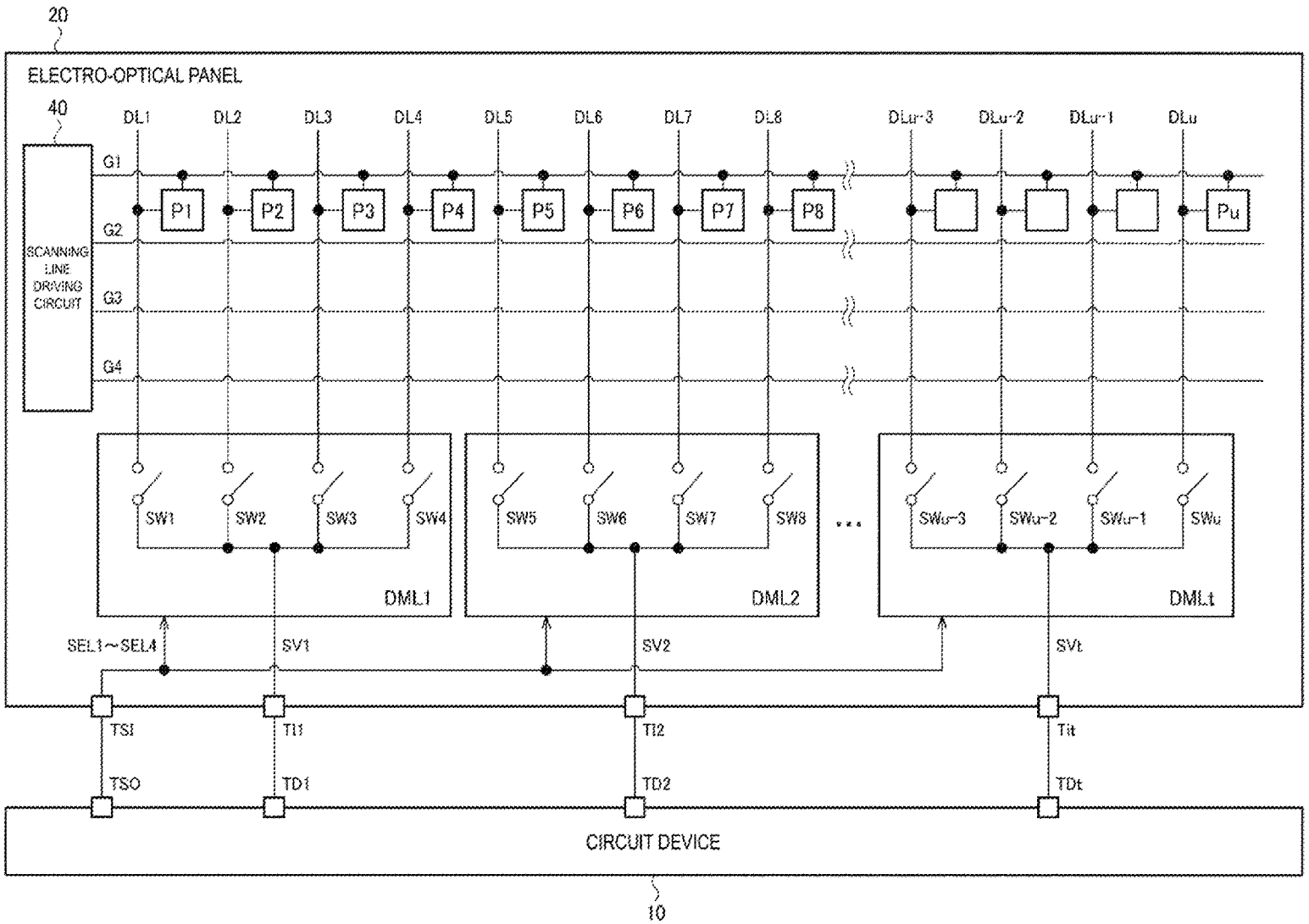
FIG. 3 is a configuration example of an electro-optical panel.

FIG. 3 is a configuration example of the electro-optical panel 20 which is driven by the circuit device 10. The electro-optical panel 20 includes a scanning line driving circuit 40, data voltage input terminals TI1 to TIt, an input terminal TSI, demultiplexers DML1 to DMLt, data lines DL1 to DLu, and a plurality of pixels. Here, u is an integer that satisfies u=4×t, for example.

A vertical synchronization signal and a horizontal synchronization signal are supplied to the scanning line driving circuit 40. The scanning line driving circuit 40 drives the scanning line based on the supplied vertical synchronization signal and the horizontal synchronization signal. In FIG. 3, four scanning lines G1 to G4 are illustrated. Although FIG. 3, illustrates a plurality of pixels P1 to Pu to be coupled to the scanning line G1, a plurality of pixels are coupled to the other scanning lines as well.

The data voltage output terminal TD1 is coupled to the data voltage input terminal TI1 of the electro-optical panel 20. The data voltage input terminal TI1 is coupled to the data lines DL1 to DL4 via the demultiplexer DML1. The data lines DL1 to DL4 are data lines arranged side-by-side in the horizontal scanning direction in the electro-optical panel 20. The pixels P1 to P4 are coupled to the data lines DL1 to DL4, respectively.

The demultiplexer DML1 divides the time-division data voltage VD1 supplied to the data signal supply line SV1 and supplies the divided data voltage VD1 to the data lines DL1 to DL4. Specifically, the demultiplexer DML1 includes switch elements SW1 to SW4 corresponding to the data lines DL1 to DL4. The switch elements SW1 to SW4 are on/off controlled by the demultiplex switch signals SEL1 to SEL4 from the switch signal generation circuit 140. As a result, the data voltage VD1 supplied to the data signal supply line SV1 is divided and supplied to the data lines DL1 to DL4. The same applies to the demultiplexer DML2 and the subsequent demultiplexers.

Figure 4:
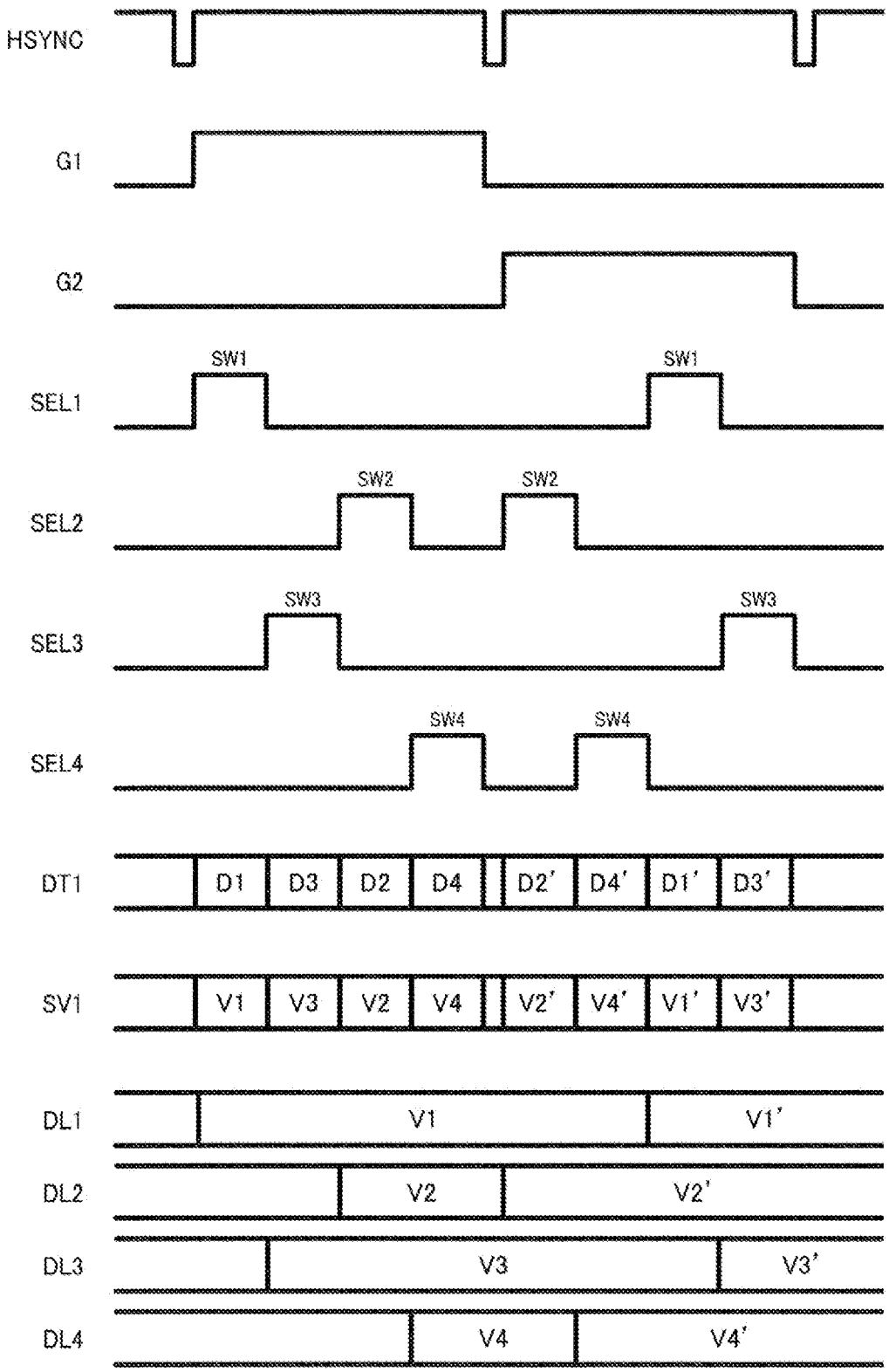
FIG. 4 is a diagram illustrating operations of the circuit device and the electro-optical panel.

FIG. 4 is a diagram illustrating operations of the circuit device 10 and the electro-optical panel 20. HSYNC in FIG. 4 represents a horizontal synchronization signal, and one cycle corresponds to one horizontal scanning period. G1 and G2 are signals representing the operation timing of the scanning line driving circuit 40. This indicates that the scanning line corresponding to G1 is selected from the plurality of scanning lines during a period when G1 is at a high level. Similarly, during a period when G2 is at the high level, the scanning line corresponding to the G2 is selected from the plurality of scanning lines.

The processing circuit 100 outputs the first to fourth display data in time-division as the display data DT1 in the horizontal scanning period. The first to fourth display data are display data corresponding to the pixels P1 to P4 coupled to the data lines DL1 to DL4, respectively. In other words, the processing circuit 100 outputs the first to fourth display data in time series. Here, the arrangement order of the first to fourth display data is set by the processing circuit 100, more specifically, the selection order setting circuit 130. For example, in the example illustrated in FIG. 4, the processing circuit 100 outputs the first display data D1, the third display data D3, the second display data D2, and the fourth display data D4 in this order in the horizontal scanning period corresponding to G1. In the next horizontal scanning period corresponding to G2, the processing circuit 100 outputs the second display data D2', the fourth display data D4', the first display data D1', and the third display data D3' in this order.

As a result, the amplifier circuit AM1 outputs the first to fourth data voltages as the data voltage VD1 in time-division. As illustrated in FIG. 4, in the horizontal scanning period corresponding to G1, the amplifier circuit AM1 outputs the first data voltage V1, the third data voltage V3, the second data voltage V2, and the fourth data voltage V4 in this order. In the next horizontal scanning period corresponding to G2, the amplifier circuit AM1 outputs the second data voltage V2', the fourth data voltage V4', the first data voltage V1', and the third data voltage V3' in this order.

Although the operation of the circuit device 10 relating to the data voltage VD1 will be described here as an example, the operation of the circuit device 10 is similar for the data voltages VD2 to VDt.

SEL1 to SEL4 are the demultiplex switch signals as described above. The switch element SW1 is turned on during a period when SEL1 is at a high level, and is turned off during a period when SEL1 is at a low level. Similarly, SEL2 to SEL4 are signals that control the switch elements SW2 to SW4.

In the horizontal scanning period, the demultiplexer DML1 selects the data lines DL1 to DL4 based on the demultiplex switch signals SEL1 to SEL4 in a predetermined order and couples the data lines DL1 to DL4 to the data voltage input terminal TI1. Specifically, when the amplifier circuit AM1 outputs the first data voltage V1, the demultiplexer DML1 couples the data line DL1 to the data voltage input terminal TI1. As a result, the data line DL1 is driven by the first data voltage V1. Similarly, the data lines DL2 to DL4 are driven by the second to fourth data voltages V2 to V4.

In the example of FIG. 4, in the horizontal scanning period corresponding to G1, by setting the demultiplex switch signals SEL1 to SEL4 to the high level in the order of SEL1, SEL3, SEL2, and SEL4, the data lines DL1 to DL4 are coupled to the voltage input terminals TI1 in the order of DL1, DL3, DL2, and DL4. In the next horizontal scanning period, the data lines DL1 to DL4 are coupled to the voltage input terminal TI1 in the order of DL2, DL4, DL1, and DL3. As a result, the data voltages supplied to the data lines DL1 to DL4 change as illustrated in FIG. 4.

In the multiplex drive, it is known that an order offset occurs in accordance with the selection order of data lines. Then, due to the order offset, a deviation occurs in the brightness value of the pixel, and display irregularity occurs in the display image.

In order to deal with this, in JP-A-2010-181516, any of a plurality of predetermined rotation patterns is selected according to some rule. For example, the rotation pattern is determined by using a horizontal synchronization signal or a vertical synchronization signal of the image output as a trigger. However, in the method of JP-A-2010-181516, there is regularity in the selection of the rotation pattern. As a result, the display irregularity on the display surface is present in accordance with a certain rule. In particular, when the cycle of the rotation pattern is short, the display irregularity may be easily visually recognized. Further, it is also conceivable that the display irregularity may be visually recognized as moving for each frame in accordance with the above rule. In other words, in the known method for selecting a rotation pattern prepared in advance, as in JP-A-2010-181516, there is a problem that the cycle of the rotation pattern is short and regular. In addition, in order to suppress that the display irregularity according to the rule is visually recognized, it is necessary to hold many rotation patterns in advance.

On the other hand, as in JP-A-2003-58119, a method for randomly determining a selection order is also conceivable. However, when the selection order is determined completely randomly, there is a selection order in which display irregularities gather and appear at a certain position on the display surface. In this case, since the display irregularities are adjacent each other, the gathering display irregularities are visually recognized by the user.

As illustrated in FIGS. 1 to 3, the method of the exemplary embodiment can be applied to the circuit device 10 that drives the electro-optical panel 20 including the demultiplexer provided between the first to n-th data lines (n is an integer of three or greater) and the data signal supply line. In the example illustrated in FIGS. 1 to 3, the demultiplexer here is, for example, DML1, the first to n-th data lines are DL1 to DL4, and the data signal supply line is SV1. Alternatively, the demultiplexer may be DML2, the first to n-th data lines may be DL5 to DL8, and the data signal supply line may be SV2. Further, the circuit device 10 of the exemplary embodiment may execute the process described below for two or more demultiplexers included in the electro-optical panel 20. The two or more demultiplexers are all the demultiplexers DML1 to DMLt which are included in the electro-optical panel 20 in a narrow sense. In the following, for the sake of simplification, the description will focus on the one demultiplexer DML1.

The circuit device 10 includes the data line driving circuit 200 that outputs a data signal to the data signal supply line SV1, and the processing circuit 100 that sets the selection order, by the demultiplexer DML1, of the first to n-th data lines. The processing circuit 100, when an i-th data line (i is an integer of 1 to n) is selected j-th (j is an integer of 1 to n) in a first selection order, which is a current selection order of a first to n-th data lines, sets a second selection order using the random number information so as to prohibit the i-th data line from being selected j-th in the second selection order, which is a next selection order of the first to n-th data lines.

Here, the selection order of the first to the n-th data lines specifically refers to the selection order in the horizontal scanning period. In other words, the first selection order is a selection order of the data lines in one given horizontal scanning period, and the second selection order is a selection order of the data lines in the following horizontal scanning period.

The random number information of the exemplary embodiment is, for example, a random number generated by a random number generation circuit 136 described later. The random number generation circuit 136 is a circuit that outputs a random number, when a range is given, within the given range, for example. However, the random number information may be information based on the circular constant or the natural logarithm. For example, the random number information may be information acquired by reading a given digit of the circular constant or the natural logarithm.

FIG. 5 is a diagram illustrating a selection order to be prohibited in the method of the exemplary embodiment. FIG. 5 is a diagram illustrating a plurality of pixels included in the electro-optical panel 20 and a selection order for each pixel. Note that, in FIG. 5 and subsequent figures, examples in which the number of signals to be demultiplexed is eight will be described. In other words, the first to the n-th data lines correspond to eight data lines DL1 to DL8. DL1 to DL8 illustrated in FIG. 5 are data lines that are coupled to the one demultiplexer DML1.

In the example of FIG. 5, in the horizontal scanning period for driving the N-th line, the first data line DL1 is selected first, the second data line DL2 is selected second, and the third data line DL3 is selected third. Regarding the pixel, in the example of FIG. 5, the pixel coupled to the first data line DL1 is driven first, the pixel coupled to the second data line DL2 is driven second, and the pixel coupled to the third data line DL3 is driven third. Hereinafter, the pixel coupled to the i-th data line is referred to as the i-th pixel.

In the example of FIG. 5, in the horizontal scanning period for driving the (N+1)-th line, which is the line next to the N-th line, the first pixel is driven fourth, the second pixel is driven second, and the third pixel is driven sixth. For example, when a deviation in the data voltage applied to the second driven pixel increases due to the order offset, a display irregularity occurs in the second pixel of the N-th line and the second pixel of the (N+1)-th line. As a result, since the display irregularities are continuous, the display irregularities are likely to be visually recognized as a vertical line. The same applies to the relationship between the (N+1)-th line and the next (N+2)-th line.

According to the method of the exemplary embodiment, when the i-th data line is selected j-th in the first selection order, the second selection order is set so as to satisfy the condition that the i-th data line is not selected j-th in the second selection order. Further, for portions not related to the above conditions, the second selection order is set using the random number information. As a result, it is possible to suppress both that the display irregularity according to the rotation rule is visually recognized and the display irregularity in the vertical direction is visually recognized. In other words, since the method of the exemplary embodiment can generate an irregular rotation pattern having a long cycle by using random number information, it becomes possible to make the display irregularity less visible.

FIG. 6 is a diagram illustrating another example of a prohibited selection order in the exemplary embodiment. In the example of FIG. 6, in the horizontal scanning period for driving the N-th line, the first pixel is driven first, the second pixel is driven second, and the third pixel is driven third. Then, in the horizontal scanning period for driving (N+1)-th line, which is the next horizontal scanning period, the first pixel is driven second, the second pixel is driven fourth, and the third pixel is driven sixth. Similar to the example of FIG. 5, a case where the deviation in the data voltage applied to the second driven pixel increases due to the order offset is taken as an example. In the example of FIG. 6, the pixel selected second is the second pixel at the N-th line and the first pixel at the (N+1)-th line. In this case, although the display irregularities are not continuous in the vertical direction, the display irregularities concentrate in a narrow range, so that the display irregularities are easily visible.

Therefore, in the second selection order, the processing circuit 100 of the exemplary embodiment may set the second selection order so as to prohibit the (i−1)-th data line and the (i+1)-th data line (i is an integer of two or greater and n−1 or less) from being selected j-th. For example, not only the second pixel in the (N+1)-th line, but also the first pixel and the third pixel are prohibited from being selected second, so that the selection order illustrated in FIG. 6 is not adopted. In this way, by further dispersing the display irregularities, it becomes possible to make the display irregularities less visible. When n=3, the data line that could be selected j-th does not exist in the second selection order, so n in this case is an integer of four or greater.

It is assumed that the electro-optical panel 20 driven by the circuit device 10 of the exemplary embodiment includes the plurality of demultiplexers DML1 to DMLt as illustrated in FIG. 3. It is also assumed that common demultiplex switch signals are supplied to the plurality of demultiplexer DML1 to DMLt. The demultiplex switch signals are, for example, SEL1 to SEL4 described above. In other words, in the example illustrated in FIGS. 1 to 3, when the data line DL1 is selected j-th by the demultiplexer DML1 in the first selection order, the data line DL5 is selected j-th by the demultiplexer DML2.

Figure 7:
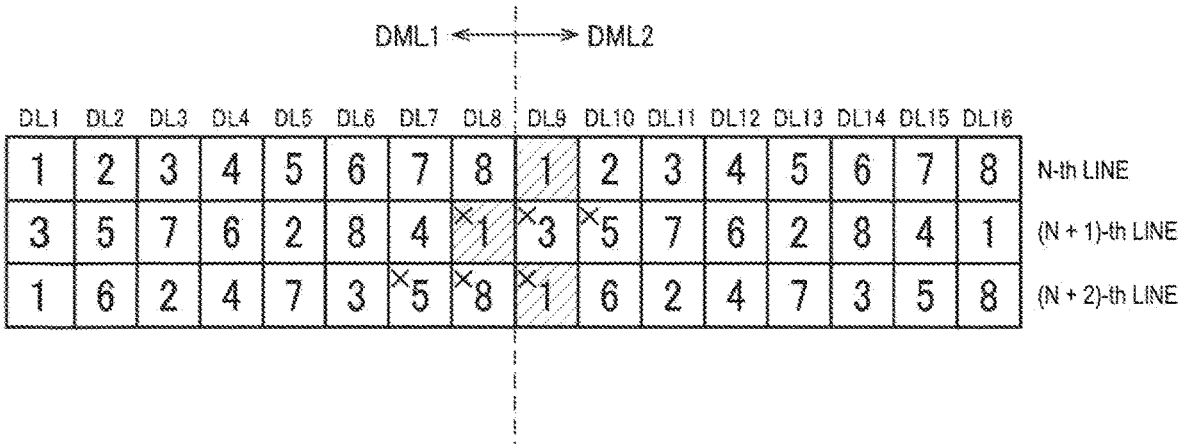
FIG. 7 is an example of a prohibited selection order.

FIG. 7 is a diagram illustrating an example of a prohibited selection order when the plurality of demultiplexers DML1 and DML2 are used. In the example of FIG. 7, in the horizontal scanning period for driving the N-th line, the first pixel is driven first, and the eighth pixel is driven eighth. Then, in the horizontal scanning period for driving (N+1)-th line, which is the next horizontal scanning period, the eighth pixel is driven first. As illustrated in FIG. 7, when using the two demultiplexers DML1 and DML2, the eighth data line DL8 of the demultiplexer DML1 and the first data line DL9 of the demultiplexer DML2 are adjacent to each other. Thus, the eighth pixel of the demultiplexer DML1 and the first pixel of the demultiplexer DML2 are adjacent to each other. When the deviation in the data voltage applied to the first driven pixel increases due to the order offset, the display irregularities concentrate in a narrow range in the selection order illustrated in FIG. 7, so that the display irregularities are easily visible.

Therefore, when i=1, "prohibiting the (i−1)-th data line, the i-th data line, and the (i+1)-th data line from being selected j-th in the second selection order" corresponds to prohibiting the n-th data line, the first data line, and the second data line from being selected j-th. Similarly, when i=n, the (n−1)-th data line, the n-th data line, and the first data line are prohibited from being selected j-th. That is, i−1 and i+1 here are addition and subtraction modulo n, where 0 is equivalent to n and n+1 is equivalent to 1.

However, the method of the exemplary embodiment is not limited thereto, and when i=1, in the second selection order, the first data line and the second data line may be prohibited from being selected j-th and the n-th data line may not be prohibited from being selected j-th. Similarly, when i=n, in the second selection order, the (n−1)-th data line and the n-th data line may be prohibited from being selected j-th and the first data line may not be prohibited from being selected j-th.

2. SELECTION ORDER DETERMINATION PROCESS

2.1 Process Flow

Figure 8:
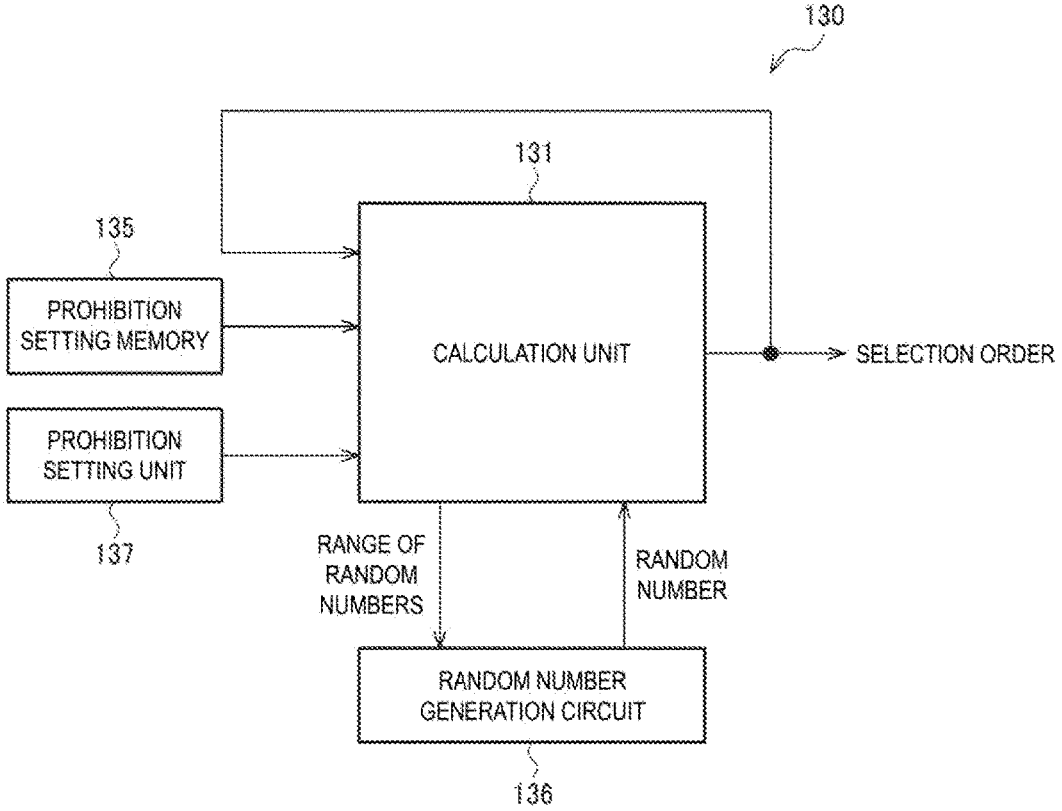
FIG. 8 is a configuration example of a selection order setting circuit.

FIG. 8 is a diagram illustrating a configuration example of the selection order setting circuit 130 included in the processing circuit 100. The selection order setting circuit 130 includes a calculation unit 131, a prohibition setting memory 135, and a random number generation circuit 136. The selection order setting circuit 130 may include a prohibition setting unit 137. However, the selection order setting circuit 130 is not limited to the configuration in FIG. 8, and various modifications can be implemented by omitting some of these components, adding another component, and the like. For example, when the prohibition setting is fixed, the prohibition setting unit 137 may be omitted.

The prohibition setting memory 135 stores the prohibition setting information specifying the prohibition setting. The prohibition setting is a setting of which data line is prohibited from being selected in which order in the second selection order. For example, the prohibition setting memory 135 stores information specifying a matrix to be described later using the following equation (1) as the prohibition setting information. The prohibition setting memory 135 may be a read only memory (ROM) or a register. Further, as will be described later, the prohibition setting memory 135 may store a plurality of prohibition setting information, and output any one piece of prohibition setting information to the calculation unit 131 based on the control information from the prohibition setting unit 137.

The random number generation circuit 136 is a circuit that acquires information designating a range of random number from the calculation unit 131 and generates a random number within the range. Circuits having various configurations such as a feedback shift register are known as the random number generation circuit 136, and these methods can be widely applied in the exemplary embodiment. Further, the random number information in the exemplary embodiment may be acquired by sequentially reading numerical values in the digits of the predetermined range of the circular constant or the natural logarithm.

The calculation unit 131 performs a process of setting the second selection order based on the first selection order, the prohibition setting information, and the random number information. The calculation unit 131 may be hardware such as an application specific integrated circuit (ASIC) or may be a processor such as a DSP.

Figure 9:
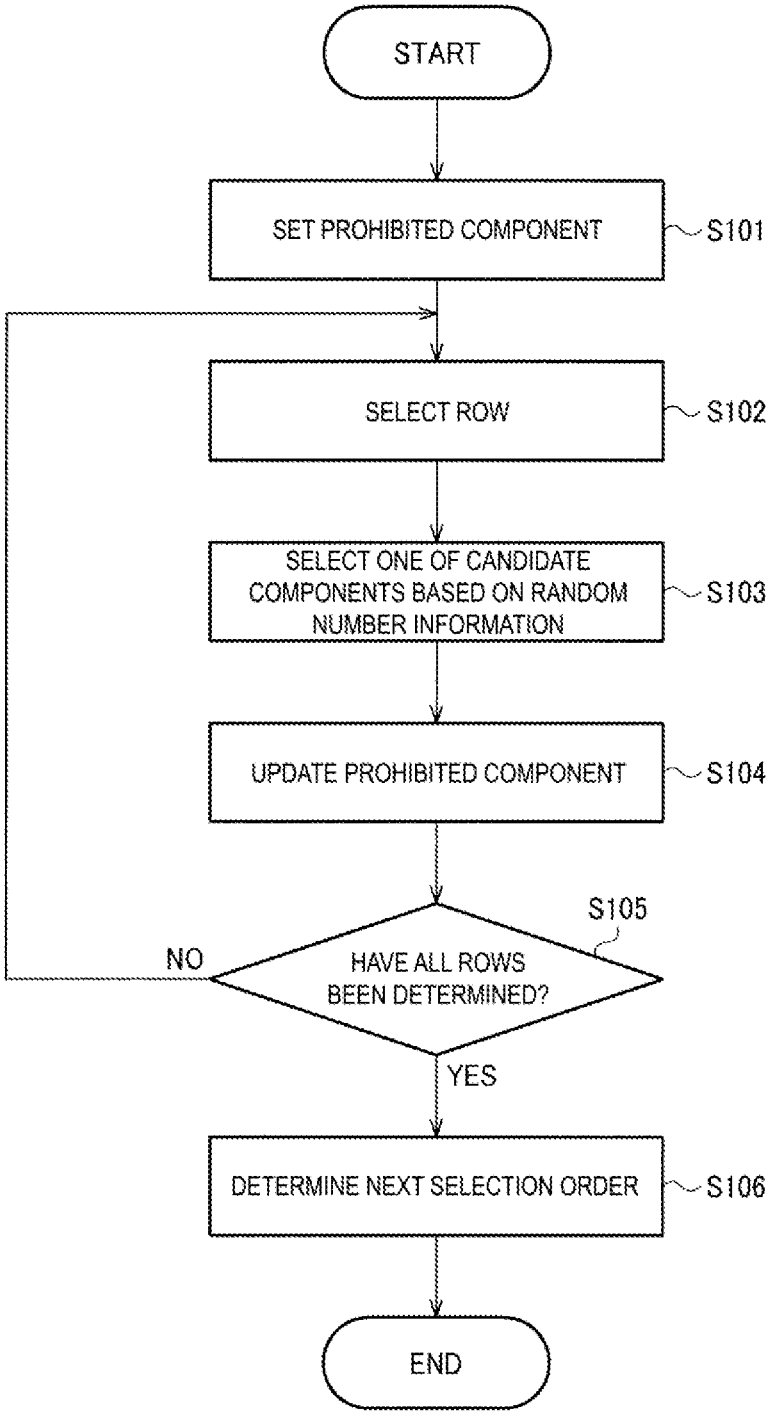
FIG. 9 is a flowchart illustrating a process in the selection order setting circuit.

FIG. 9 is a flowchart illustrating a setting process for the second selection order. When this process is started, first in step S101, the calculation unit 131 acquires a matrix T in which the prohibition components are set. The matrix T is read from the prohibition setting memory 135, for example.

Next, in step S102, the calculation unit 131 selects any row of the matrix T. In step S103, the calculation unit 131 selects any one of the candidate components of the row selected in step S102 using the random number information. The candidate components are components other than the prohibition component in the target row. Next, in step S104, the calculation unit 131 updates the matrix T in accordance with the selected candidate component. The process updating the matrix T will be described later.

In step S105, the calculation unit 131 decides whether the process of determining one of the candidate components has been performed for all rows of the matrix T. When No in step S105, then the calculation unit 131 returns to step S102 and selects any of the unprocessed rows. When Yes in step S105, in step S106, the calculation unit 131 sets the second selection order based on the processed matrix T.

Hereinafter, the process of each step illustrated in FIG. 9 will be described in detail. In the following, a case where the number of signals to be demultiplexed is eight will be described.

First, when the current writing is for an N-th line, the first selection order is defined using a column vector $P_N$. For example, when $P_N=(2, 3, 4, 5, 6, 7, 8, 1)^T$, the first pixel is written second, and the second pixel is written third. Here, the calculation unit 131 uses the matrix T illustrated in the following equation (1) to determine a second selection order $P_{N+i}$ when writing for the (N+1)-th line by the following equation (2). When the number of signals to be demultiplexed is n, then $P_N$ and $P_{N+1}$ are column vectors of n rows and one column, and T is the matrix of n rows and n columns. As described above, an example of n=8 will be described here. The initial selection order P1 is arbitrary.

[Mathematical Equation 1]

$$T=\begin{pmatrix} X & X & \sigma_{13} & \sigma_{14} & \sigma_{15} & \sigma_{16} & \sigma_{17} & X \\ X & X & X & \sigma_{24} & \sigma_{25} & \sigma_{26} & \sigma_{27} & \sigma_{28} \\ \sigma_{31} & X & X & X & \sigma_{35} & \sigma_{36} & \sigma_{37} & \sigma_{38} \\ \sigma_{41} & \sigma_{42} & X & X & X & \sigma_{46} & \sigma_{47} & \sigma_{48} \\ \sigma_{51} & \sigma_{52} & \sigma_{53} & X & X & X & \sigma_{57} & \sigma_{58} \\ \sigma_{61} & \sigma_{62} & \sigma_{63} & \sigma_{64} & X & X & X & \sigma_{68} \\ \sigma_{71} & \sigma_{72} & \sigma_{73} & \sigma_{74} & \sigma_{75} & X & X & X \\ X & \sigma_{82} & \sigma_{83} & \sigma_{84} & \sigma_{85} & \sigma_{86} & X & X \end{pmatrix} \quad (1)$$

[Mathematical Equation 2]

$$P_{N+1}=T\times P_N \quad (2)$$

In the matrix T, X represents a prohibition component. Although X is specifically 0, here, in order to distinguish the initial prohibition component from the prohibition component to be updated based on the determination of other rows, the initial prohibition component is expressed as X. The $\sigma_{pq}$ of the matrix T is a variable that becomes 0 or 1. Note that p and q are each an integer of 1 to n.

As described above, the p-th component of $P_N$ represents the order of the p-th pixel selected in the first selection order. Then, the p-th component of $P_{N+1}$ is obtained by calculating the p-th row of the matrix T and $P_N$. For example, as described later, when $\sigma_{15}=1$, the first pixel in the second selection order is equal to the selection order of the fifth pixel in the first selection order. Since the first pixel is not written a plurality of times in the second selection order, it is not necessary to refer to a plurality of components included in $P_N$ when setting $P_{N+1}$. Thus, in each row of the matrix T, one of the components is set to 1, and the other components are set to 0.

In addition, two or more pixels are not simultaneously written by the one demultiplexer DML1. For example, as described later, when the first pixel is written sixth in the second selection order due to $\sigma_{15}=1$, the second to eighth pixels are not written sixth in the second selection order. That is, in each column of the matrix T, any one of the components is set to 1, and the other components are set to 0.

That is, the process for setting the second selection order is executed by the process for determining the matrix T satisfies the following three conditions (A) to (C).

(A) The prohibition component X is set according to the given prohibition setting, and X=0

(B) Only one component in each row is 1 and the other components are 0

(C) Only one component in each column is 1 and the other components are 0

As described above, the processing circuit 100 obtains the second selection order using the first selection order and the matrix T for obtaining the second selection order from the first selection order. For example, when the first selection order and the second selection order are defined by $P_N$ and $P_{N+1}$, which are column vectors of n rows and one column, respectively, the matrix T is an n row and n columns matrix.

In this way, since the second selection order is determined after referring to the first selection order, the second selection order can be set so as to satisfy the prohibition setting for preventing the display irregularity from being visually recognized. The matrix T here has a prohibition component that prohibits the i-th data line from being selected j-th in the second selection order. In this way, by setting the given component included in the matrix T as the prohibition component, it is possible to satisfy at least the prohibition setting for preventing display irregularity, which is a vertical line, from being visually recognized.

The prohibition components is specifically a diagonal component of the matrix T. In the example of the above equations (1) and (2), the p-th row of the matrix T is information for selecting a selection order of the p-th pixel in the second selection order. Further, the p-th column in the matrix T is information that refers to the selection order of the p-th pixel in the first selection order when determining the order in the second selection order. In other words, the diagonal component $a_{pp}$ is information that refers to the selection order of the p-th pixel in the first selection order when selecting the selection order of the p-th pixel in the second selection order. In a case where the diagonal component $a_{pp}$ is valid, when the i-th data line is selected j-th in the first selection order, the i-th data line can be selected j-th in the second selection order. By setting the diagonal component as the prohibition component, it is possible to suppress the visual recognition of the vertical line as illustrated in FIG. 5.

However, in the above equation (1), when the i-th data line is selected j-th in the first selection order, the (i−1)-th data line, the i-th data line, and the (i+1)-th data line are prohibited from being selected j-th in the second selection order. For example, the second pixel in the second selection order is prevented from being written in any of the order of the second pixel, the order of the first pixel, and the order of the third pixel in the first selection order. Thus, in the second row of the matrix T for determining the order of the second pixel in the second selection order, the first column to the third column are set as prohibition components.

The same applies to the other rows, and when component in the p-row and q-column of the matrix T is represented by $a_{pq}$ (p and q are integers of one or grater and n or less), the prohibition components are $a_{pp}$, $a_{p(p-1)}$, and $a_{p(p+1)}$. As described above, p−1 and p+1 here are addition and subtraction modulo n, and the prohibition components when p=1 are $a_{18}$, $a_{11}$, and $a_{12}$, and the prohibition components when p=8 are $a_{87}$, $a_{88}$, and $a_{81}$. By setting the prohibition components in this way, it becomes possible to further disperse the display irregularities.

The process illustrated in step S101 in FIG. 9 is a process of acquiring the matrix T in a state in which the prohibition component has been set and none of values of $\sigma_{pq}$ have not been determined. Hereinafter, the value of the matrix T in this state is also denoted as an initial value of the matrix T.

In order to determine the second selection order, the specific matrix T satisfying the three conditions (A) to (C) described above needs to be determined. In the method of the exemplary embodiment, the matrix T is determined using the random number information instead of preparing a plurality of rotation patterns in advance.

FIG. 10 is a diagram illustrating the processes of S102 to S104 in the processes for determining the matrix T. The calculation unit 131 selects one unprocessed row in the matrix T and sets any one of the candidate components included in the row to 1. In the example of FIG. 10, when all the rows are unprocessed, the calculation unit 131 selects a first row of the matrix T (step S102). There are five candidate components in the first row, $\sigma_{13}$ to $\sigma_{17}$, as shown in the above equation (1). In the example illustrated in FIG. 10, the calculation unit 131 sets the value of $\sigma_{15}$ selected based on the random number information from the random number generation circuit 136 to 1 (step S103). The calculation unit 131 sets the other components of the first row, specifically, $\sigma_{13}$, $\sigma_{14}$, $\sigma_{16}$, and $\sigma_{17}$ to 0 so as to satisfy the condition (B) described above. Since the prohibition components are originally 0, the values do not need to be updated. The calculation unit 131 sets the other components of the fifth column, specifically, $\sigma_{25}$, $\sigma_{35}$, $\sigma_{75}$, and $\sigma_{85}$ to 0 so as to satisfy the condition (C) described above (step S104). Also, in the column direction, since the prohibition components are originally 0, the values do not need to be updated.

Since the first row of the matrix T is determined by the processes described above, the component of the first row of $P_{N+1}$ can be determined based on the information of the first row and $P_N$. In a broad sense, when components other than the prohibition component are considered as candidate components among the components included in the p-th row of the matrix (p is an integer of 1 to n), the processing circuit 100 selects one component from the candidate components in the p-th row using the random number information, as illustrated in FIG. 10. Then, the processing circuit 100 obtains the p-th component in the second selection order based on the p-th row after selection and the first selection order. That is, it is possible to randomly determine the second selection order while satisfying the prohibition setting.

In addition, the process of setting the $\sigma_{25}$, $\sigma_{35}$, $\sigma_{75}$, and $\sigma_{85}$ to 0 described above is as follows in a broad sense. When the candidate component selected from the candidate components in the p-th row using the random number information is in the q-th column (q is an integer of 1 to n), the processing circuit 100 sets, in the matrix T, the components in the q-th column of the undetermined rows, which are the rows in which candidate components are not selected based on the random number information as prohibition components. Here, "set as prohibition components" means that the target components do not contribute to the determination of the second selection order. Here, the process for setting the prohibition component is a process in which the value of $\sigma$ is set to 0, but the prohibition component may be set by a process other than this.

As described above, the component of the first row of $P_{N+1}$ can be determined by performing the process to determine one of the candidate components for the first row of the matrix T. That is, in order to determine all the components of the $P_{N+1}$, it is necessary to perform the similar processes for all the rows of the matrix T. Thus, as illustrated in FIG. 9, when No in step S105, the processes in steps S102 to S104 are repeated.

Note that, in the process of step S102 second and subsequent times, the calculation unit 131 may randomly select one row from the unprocessed rows of the matrix T. However, in the method of the exemplary embodiment, one or more prohibition components are set in each row of the matrix T. Then, by processing on another row may increase the number of prohibition components in the unprocessed rows by one. In the example of the above equation (1), there are five candidate components in each row in the initial state. Thus, when rows are randomly selected, there is a possibility that the number of candidate components becomes zero in the rows to be selected sixth to eighth times.

For example, after the process illustrated in FIG. 10, it is assumed that, by repeating the steps S102 and S103, the respective processes of selecting $\sigma_{36}$ in the third row, selecting $\sigma_{42}$ in the fourth row, selecting $\sigma_{53}$ in the fifth row, and selecting $\sigma_{64}$ in the sixth row are performed. In this case, by selecting $\sigma_{36}$, the value of $\sigma_{86}$ in the eighth row is updated to 0, that is, the prohibition component. Similarly, the values of $\sigma_{82}$, $\sigma_{83}$, and $\sigma_{84}$ are updated to 0 by selecting $\sigma_{42}$, $\sigma_{53}$, and $\sigma_{64}$. At this stage, since all the components in the eighth row are updated to the prohibition components, the order of the eighth pixels in the second selection order cannot be determined.

When the candidate component in any of the rows no longer exists in this way, the calculation unit 131 may initialize the matrix T once and start the determination process for the matrix T again from the state of the above equation (1). In the exemplary embodiment, since the process of step S103 is randomly executed, it is possible to increase the probability of determining the matrix T that satisfies the conditions by increasing the number of trials.

However, the processing circuit 100 may execute a process to select one component from the candidate components using the random number information, for the row including fewest candidate components among the unprocessed rows. In this way, the matrix T satisfying the conditions can be reliably determined.

For example, in the state of FIG. 10, the number of candidate components in the second row is four, $\sigma_{24}$, $\sigma_{26}$, $\sigma_{27}$, and $\sigma_{28}$. Similarly, the numbers of candidate components in the third to eighth rows are 4, 5, 5, 5, 4, and 4, respectively. Thus, in the second row selection, the calculation unit 131 selects any of the second row, third row, seventh row, and eighth row. The same applies thereafter, and the calculation unit 131 counts the number of candidate components in each row after the prohibition component is updated, and prioritizes the row with the smallest count result as the processing target. Note that, in the following, the number of candidate components is expressed as the number of candidates.

As shown in the above equation (1), in the exemplary embodiment, the set of prohibition components in a given row of the matrix T does not match the set of prohibition components in other rows. Thus, when one of the candidate components of the given row is selected, there are rows in which the number of candidates decreases and rows in which the number of candidates does not decrease because the target column was originally the prohibition component. By preferentially selecting rows including a small number of candidates, it is possible to prevent the number of candidates for two or more rows from simultaneously becoming 0.

The following equation (3) is an example of the matrix T acquired by repeating the processes in S102 to S105 in FIG. 9. The matrix T shown in the equation (3) satisfies the conditions (A) to (C) described above.

[Mathematical Equation 3]

$$T = \begin{pmatrix} X & X & 0 & 0 & 1 & 0 & 0 & X \\ X & X & X & 1 & 0 & 0 & 0 & 0 \\ 0 & X & X & X & 0 & 0 & 0 & 1 \\ 0 & 0 & X & X & X & 1 & 0 & 0 \\ 0 & 0 & 0 & X & X & X & 1 & 0 \\ 1 & 0 & 0 & 0 & X & X & X & 0 \\ 0 & 0 & 1 & 0 & 0 & X & X & X \\ X & 1 & 0 & 0 & 0 & 0 & X & X \end{pmatrix} \quad (3)$$

Since the process for all the rows has been completed, the calculation unit 131 decides Yes in step S105. Thus, based on the following equation (4), the calculation unit 131 determines $P_{N+1}$ representing the second selection order. As shown in the following equation (4), when $P_N=(2, 3, 4, 5, 6, 7, 8, 1)^T$, then $P_{N+1}=(6, 5, 1, 7, 8, 2, 4, 3)^T$.

[Mathematical Equation 4]

$$P_{N+1} = \begin{pmatrix} X & X & 0 & 0 & 1 & 0 & 0 & X \\ X & X & X & 1 & 0 & 0 & 0 & 0 \\ 0 & X & X & X & 0 & 0 & 0 & 1 \\ 0 & 0 & X & X & X & 1 & 0 & 0 \\ 0 & 0 & 0 & X & X & X & 1 & 0 \\ 1 & 0 & 0 & 0 & X & X & X & 0 \\ 0 & 0 & 1 & 0 & 0 & X & X & X \\ X & 1 & 0 & 0 & 0 & 0 & X & X \end{pmatrix} \times \begin{pmatrix} 2 \\ 3 \\ 4 \\ 5 \\ 6 \\ 7 \\ 8 \\ 1 \end{pmatrix} = \begin{pmatrix} 6 \\ 5 \\ 1 \\ 7 \\ 8 \\ 2 \\ 4 \\ 3 \end{pmatrix} \quad (4)$$

The selection order setting circuit 130 outputs a signal based on the set second selection order to the multiplexer 120 and the switch signal generation circuit 140. This makes it possible to achieve a multiplex drive in which display irregularity is less likely to be visually recognized.

2.2 Specific Configuration Example of Processing Circuit

Figure 11:
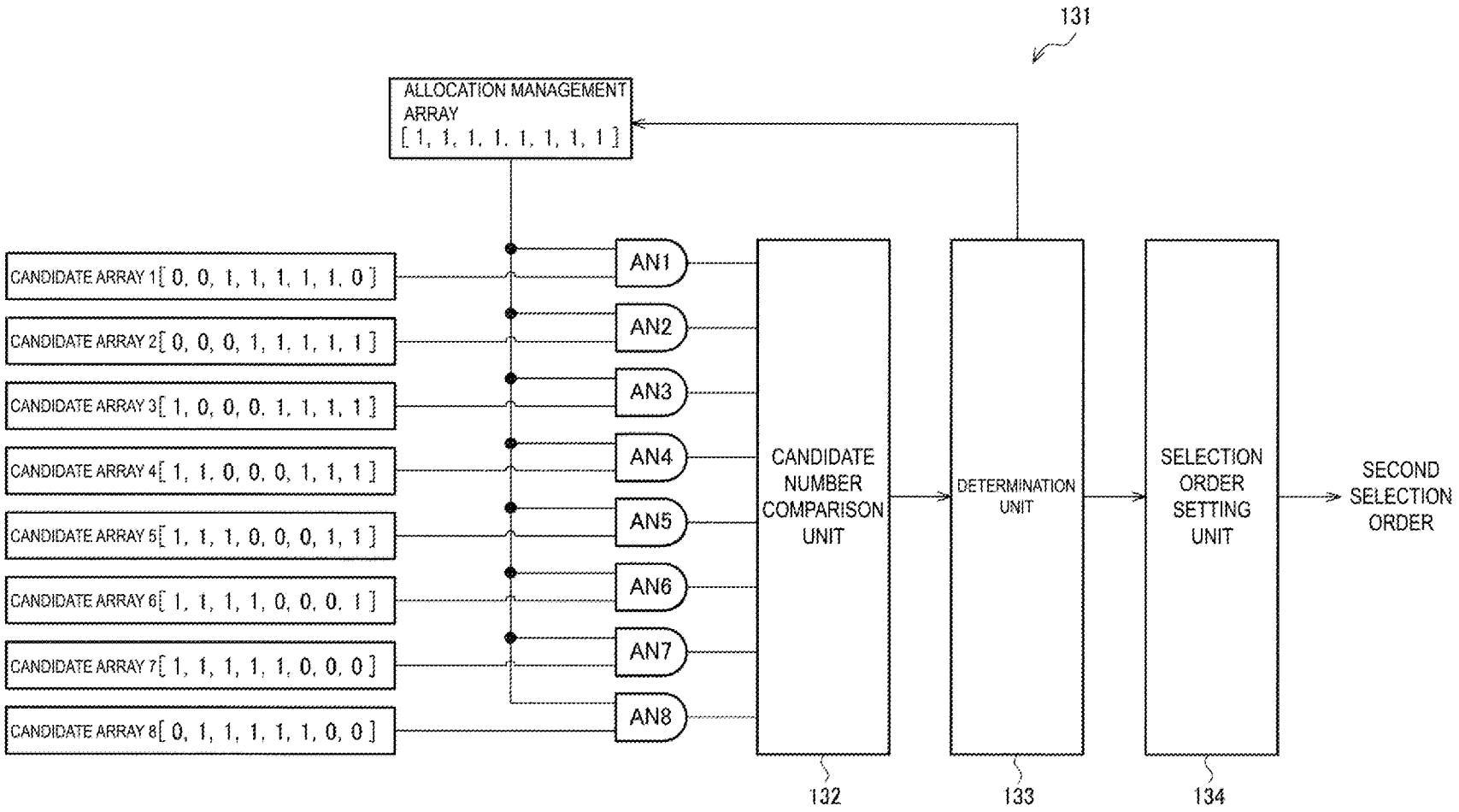
FIG. 11 is a configuration example of a calculation unit.

FIG. 11 is a specific configuration example of the calculation unit 131. The calculation unit 131 includes n candidate arrays, one allocation management array, n AND circuits AN1 to ANn, a candidate number comparison unit 132, a determination unit 133, and a selection order setting unit 134. Note that the calculation unit 131 is not limited to the configuration of FIG. 11, and various modifications can be implemented by, for example, omitting a part of the components or adding another component. For example, the number of AND circuits is not limited to n, and one AND circuit may be used in time-division.

The calculation unit 131 holds n candidate arrays corresponding to the matrix T. One candidate array is n-bit data, and is managed using, for example, n flip-flops. The candidate arrays 1 to 8 correspond to the first to eighth rows of the matrix T in the state shown in the above equation (1). For example, since the three prohibition components in the first row of the matrix T are $a_{18}$, $a_{11}$, and $a_{12}$, the value of the first bit, the second bit, and the eighth bit of the candidate array 1 is set to 0. The same applies to candidate arrays 2 to 8.

Further, the calculation unit 131 holds the allocation management array for updating the prohibition component indicated in step S104. The allocation management array is n-bit data, and is managed, for example, using n flip-flops. At the start of the determination process for the matrix T, all bits of the allocation management array are set to 1.

The calculation unit 131 includes the AND circuits AN1 to AN8. The AND circuit AN1 performs an AND operation on each bit of the candidate array 1 and the allocation management array, and outputs an array of 8-bit data, which is the calculation result, to the candidate number comparison unit 132. The same applies to the AND circuits AN2 to AN8, and the AND operation is performed on each bit of each of the candidate arrays 2 to 8 and the allocation management array to output an 8-bit array.

The candidate number comparison unit 132 counts the number of bits whose values included in the array are one in the 8-bit array outputted from the AND circuit AN1 as the number of candidates. The candidate number comparison unit 132 performs the counting process of the number of candidates as well for each of the arrays outputted from the AND circuits AN2 to AN8. The candidate number comparison unit 132 selects one of the arrays having the smallest number of candidates and outputs the selected array to the determination unit 133.

The determination unit 133 performs a process selecting any one of the bits having a value of 1 from the array outputted from the candidate number comparison unit 132 based on the random number information. The determination unit 133 outputs a determination array that is a selection result. The determination unit 133 also updates the allocation management array based on the determined information.

The selection order setting unit 134 sets the second selection order based on the n determination arrays to be outputted from the determination unit 133 and the first selection order.

Hereinafter, a specific processing procedure will be described. As illustrated in FIG. 11, the allocation management array in the initial state has all bits of 1. Thus, the eight arrays, which are the outputs of the AND circuits AN1 to AN8, are the same as those of the candidate arrays 1 to 8. As a result, the number of candidates is five in all the arrays, and the candidate number comparison unit 132 outputs an arbitrary array to the determination unit 133. For example, the candidate number comparison unit 132 outputs the candidate array 1 corresponding to the first row of the matrix T.

The determination unit 133 determines one of the five candidate components. For example, the determination unit 133 outputs five, which is the number of candidates, to the random number generation circuit 136. The random number generation circuit 136 randomly returns an integer of one or greater and five or less. For example, the determination unit 133 acquires three as the random number information from the random number generation circuit 136, and selects a third bit among the bits of which the value included in the candidate array 1 is 1. In this case, the determination unit 133 determines the value of the fifth bit corresponding to $\sigma_{15}$ to 1, as in the example in FIG. 10. The determination unit 133 outputs [0, 0, 0, 0, 1, 0, 0, 0] as the determination array 1.

In addition, since the fifth bit of the candidate array 1 has been selected, the determination unit 133 determines that the fifth bit of each array has been allocated. Specifically, the determination unit 133 performs a process to change the fifth bit of the allocation management array from 1 to 0. The above process corresponds to the processes of steps S102 to S104 of FIG. 9 for the first time.

Figure 12:
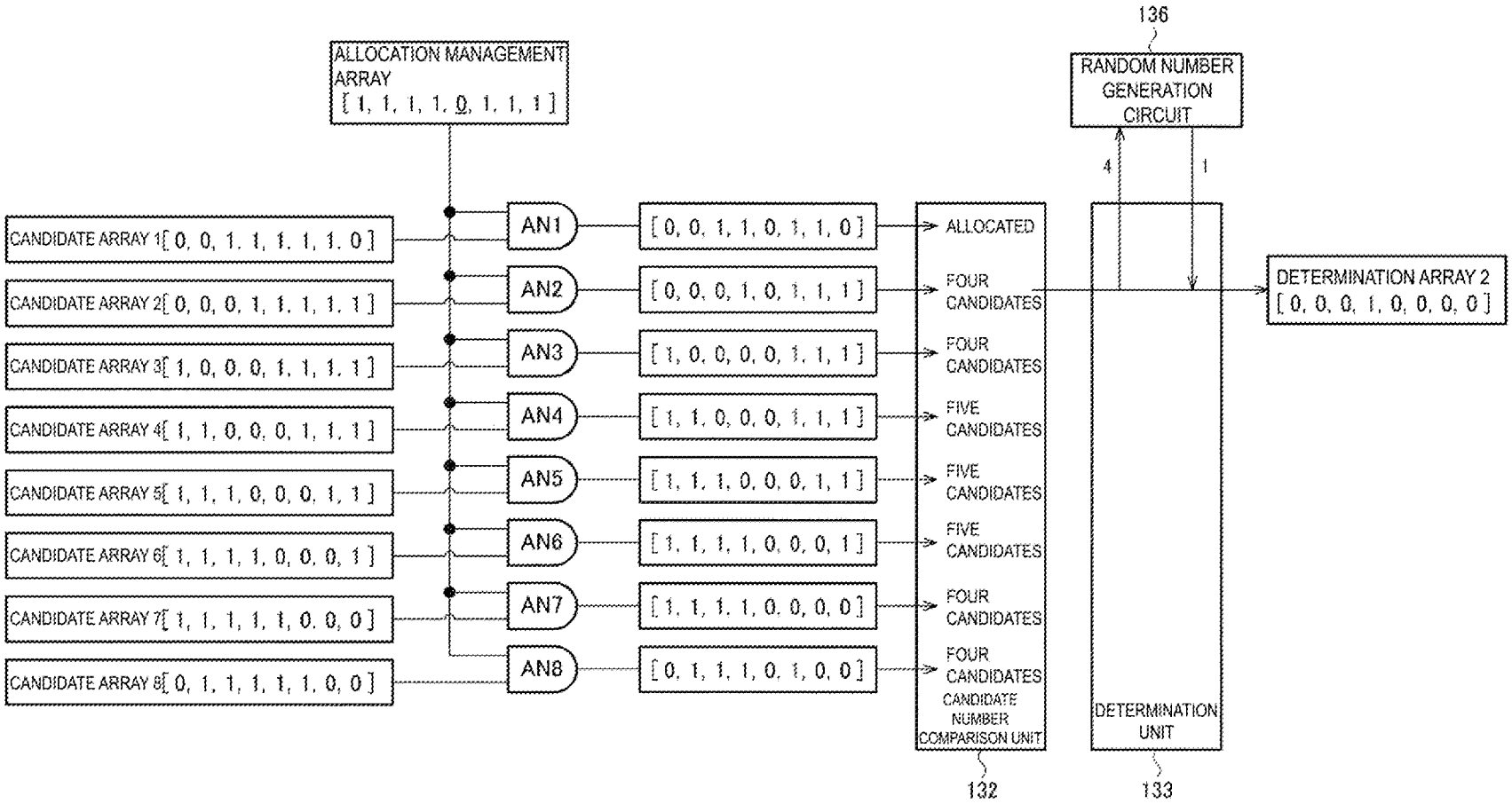
FIG. 12 is a schematic diagram illustrating a process flow.

FIG. 12 is a diagram illustrating the processes of the steps S102 to S104 for the second time. As described above, the fifth bit of the allocation management array has been changed to 0. Thus, in the arrays outputted from the AND circuits AN1 to AN8, the fifth bit is 0 in all of the arrays. That is, the process of step S104 of "the components of the q-th column of the undetermined rows are set as prohibition components when the candidate component selected using the random number information is in the q-th column" may be implemented by updating the q-th bit of the allocation management array and the AND operation of the candidate arrays and the allocation management array.

The candidate number comparison unit 132 counts the number of bits having the value of 1 as the number of candidates for each of the outputs of the AND circuits AN1 to AN8. However, since the candidate array 1 has been processed, it is not necessary to count the number of the candidates. Here, since the number of candidates four is the smallest, any of the candidate arrays 2, 3, 7, and 8 is outputted to the determination unit 133.

For example, when the candidate number comparison unit 132 outputs the candidate array 2, the determination unit 133 outputs four, which is the number of candidates, to the random number generation circuit 136. The random number generation circuit 136 randomly returns an integer of one or greater and four or less. For example, the determination unit 133 acquires one as the random number information from the random number generation circuit 136, and selects a first bit among the bits of which the value included in the candidate array 2 is 1. In this case, the determination unit 133 determines the value of the fourth bit corresponding to $\sigma_{24}$ to 1, as in the example in FIG. 10. The determination unit 133 outputs [0, 0, 0, 1, 0, 0, 0, 0] as the determination array 2. Further, the determination unit 133 performs a process to change the fourth bit of the allocation management array from 1 to 0.

Figure 13:
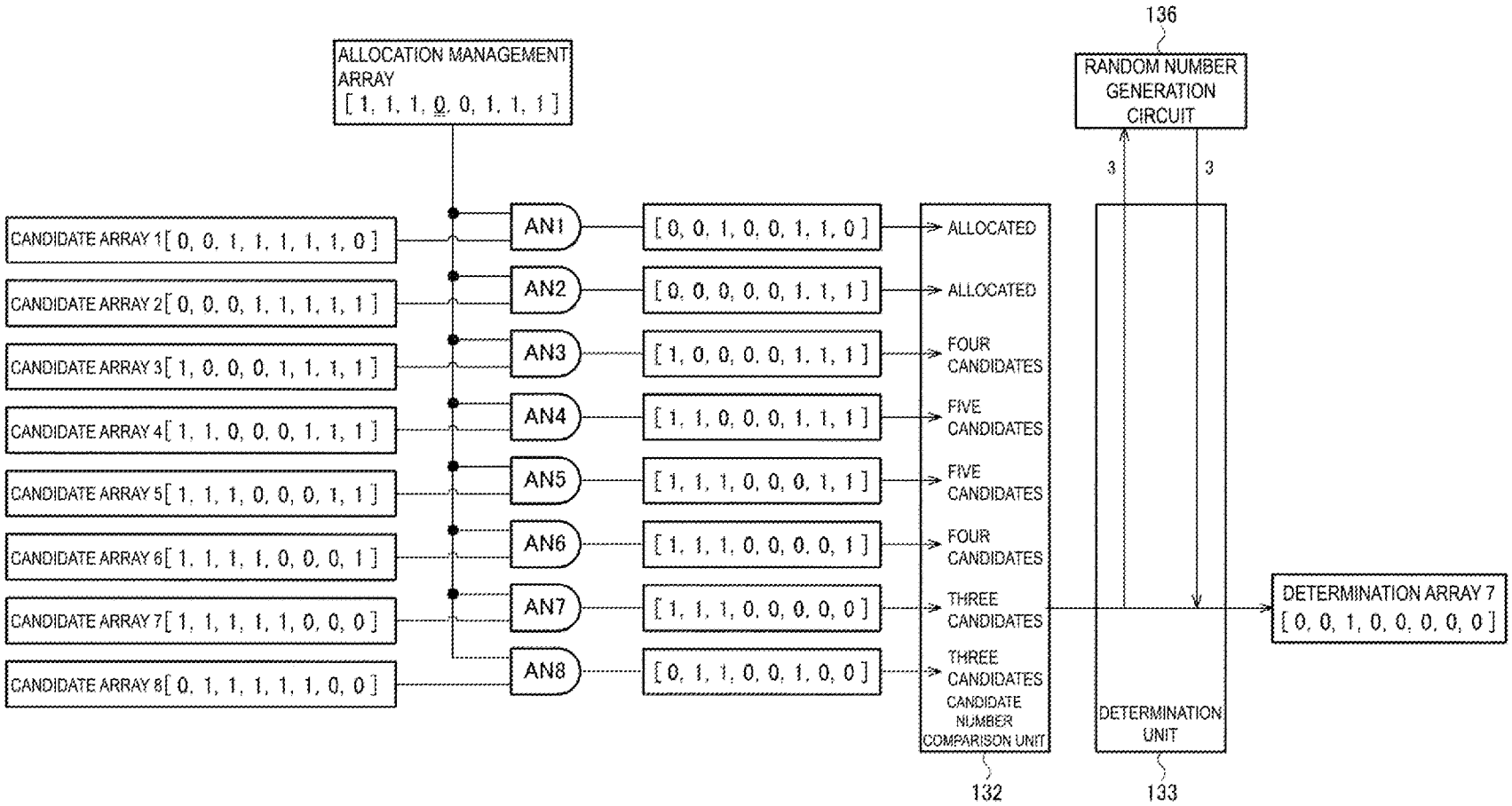
FIG. 13 is a schematic diagram illustrating a process flow.

FIG. 13 is a diagram illustrating the processes of the steps S102 to S104 for the third time. The allocation management array at this stage is [1, 1, 1, 0, 0, 1, 1, 1] and the outputs of the AND circuits AN1 to AN8 are as illustrated in the figure. In this case, since the number of candidates three is the smallest, any of the candidate arrays 7 and 8 is outputted to the determination unit 133.

For example, when the candidate number comparison unit 132 outputs the candidate array 7, the determination unit 133 outputs three, which is the number of candidates, to the random number generation circuit 136. The random number generation circuit 136 randomly returns an integer of one or greater and three or less. For example, the determination unit 133 acquires three as the random number information from the random number generation circuit 136, and selects a third bit among the bits of which the value included in the candidate array 7 is 1. In this case, the determination unit 133 determines the value of the third bit corresponding to $\sigma_{73}$ to 1, as in the example in FIG. 10. The determination unit 133 outputs [0, 0, 1, 0, 0, 0, 0, 0] as the determination array 7. Further, the determination unit 133 performs a process to change the third bit of the allocation management array from 1 to 0. Thereafter, by repeating the similar process, the determination unit 133 outputs the determination arrays 1 to 8.

Figure 14:
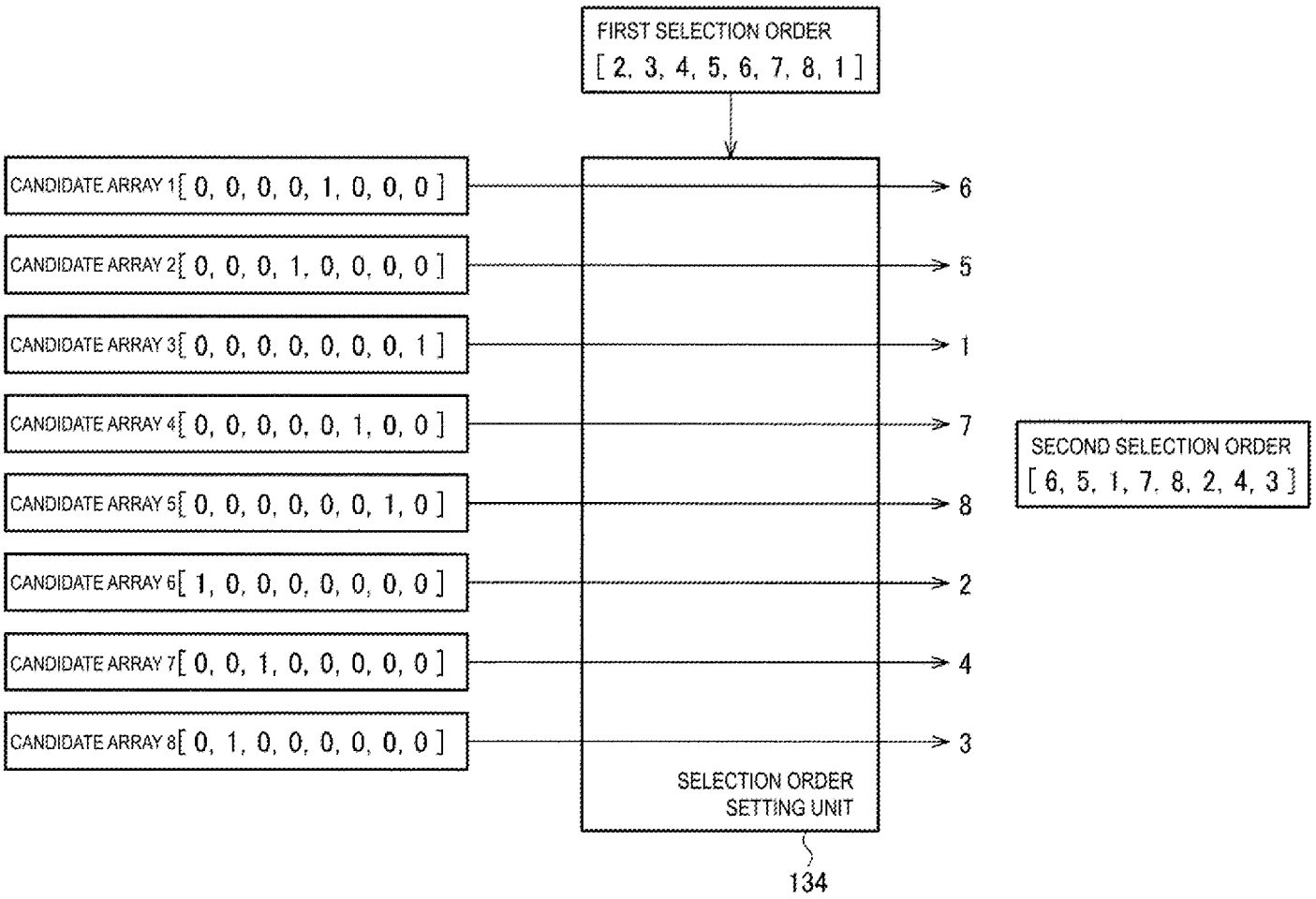
FIG. 14 is a schematic diagram illustrating a setting process for a second selection order.

FIG. 14 is a diagram illustrating the process for setting the second selection order based on the determination arrays. The selection order setting unit 134 acquires the determination arrays 1 to 8 from the determination unit 133, and also acquires an array representing the first selection order. The array representing the first selection order includes eight components, and each component is multi-bit data. The selection order setting unit 134 determines the first component in the second selection order based on the determination array 1 and the first selection order. The selection order setting unit 134 may perform a product-sum operation for multiplying each component of the determination array 1 and the array representing the first selection order to obtain the sum of the multiplication results. Alternatively, the selection order setting unit 134 may decide which bit of the determination array 1 is 1, and extract the corresponding component in the first selection order, here, the fifth component. Based on the determination array 1 and the first selection order, the first component of the second selection order is determined to be six. The same applies to the second to eighth components in the second selection order.

3. MODIFIED EXAMPLES

3.1 Other Examples of Prohibition Setting and Prohibition Setting Unit

As described above, in the exemplary embodiment, for example, when the first data line is selected j-th, the prohibition setting is used to prohibit the i-th data line, the (i−1)-th data line, and the (i+1)-th data line from being selected j-th in the second selection order. However, the prohibition setting of the exemplary embodiment is not limited to the example described above, as long as the prohibition setting prohibits the i-th data line from being selected j-th in the second selection order when the i-th data line is selected j-th in the first selection order.

For example, as a prohibition setting, a first setting may be used in which the i-th data line is prohibited from being selected j-th in the second selection order, and the (i−1)-th data line and the (i+1)-th data line are not prohibited from being selected j-th. In this case, the matrix T is represented by the following equation (5). Similarly, when the following equation (5) is used, by performing the process of selecting the candidate components so as to satisfy the conditions (A) to (C) described above, the process of determining the specific matrix T is performed.

[Mathematical Equation 5]

$$T = \begin{pmatrix} X & \sigma_{12} & \sigma_{13} & \sigma_{14} & \sigma_{15} & \sigma_{16} & \sigma_{17} & \sigma_{18} \\ \sigma_{21} & X & \sigma_{23} & \sigma_{24} & \sigma_{25} & \sigma_{26} & \sigma_{27} & \sigma_{28} \\ \sigma_{31} & \sigma_{32} & X & \sigma_{34} & \sigma_{35} & \sigma_{36} & \sigma_{37} & \sigma_{38} \\ \sigma_{41} & \sigma_{42} & \sigma_{43} & X & \sigma_{45} & \sigma_{46} & \sigma_{47} & \sigma_{48} \\ \sigma_{51} & \sigma_{52} & \sigma_{53} & \sigma_{54} & X & \sigma_{56} & \sigma_{57} & \sigma_{58} \\ \sigma_{61} & \sigma_{62} & \sigma_{63} & \sigma_{64} & \sigma_{65} & X & \sigma_{67} & \sigma_{68} \\ \sigma_{71} & \sigma_{72} & \sigma_{73} & \sigma_{74} & \sigma_{75} & \sigma_{76} & X & \sigma_{78} \\ \sigma_{81} & \sigma_{82} & \sigma_{83} & \sigma_{84} & \sigma_{85} & \sigma_{86} & \sigma_{87} & X \end{pmatrix} \quad (5)$$

Alternatively, as described above, a second setting may be used that prohibits the i-th data line, the (i−1)-th data line, and the (i+1)-th data line from being selected j-th in the second selection order. Alternatively, a third setting may be used that prohibits the i-th data line, the (i−1)-th data line, the (i+1)-th data line, the (i−2)-th data line, and the (i+2)-th data line from being selected j-th in the second selection order. When using the third setting, the matrix T is represented by the following equation (6). In addition, the prohibition setting of the exemplary embodiment can be variously modified.

[Mathematical Equation 6]

$$T = \begin{pmatrix} X & X & X & \sigma_{14} & \sigma_{15} & \sigma_{16} & X & X \\ X & X & X & X & \sigma_{25} & \sigma_{26} & \sigma_{27} & X \\ X & X & X & X & X & \sigma_{36} & \sigma_{37} & \sigma_{38} \\ \sigma_{41} & X & X & X & X & X & \sigma_{47} & \sigma_{48} \\ \sigma_{51} & \sigma_{52} & X & X & X & X & X & \sigma_{58} \\ \sigma_{61} & \sigma_{62} & \sigma_{63} & X & X & X & X & X \\ X & \sigma_{72} & \sigma_{73} & \sigma_{74} & X & X & X & X \\ X & X & \sigma_{83} & \sigma_{84} & \sigma_{85} & X & X & X \end{pmatrix} \quad (6)$$

The prohibition setting in the exemplary embodiment may be predetermined in any one of the above-described prohibiting settings, and the processing circuit 100 may utilize the prohibition setting fixedly. For example, when using the second setting, the initial value of the matrix T is fixed to the value of the above equation (1). Alternatively, the candidate arrays 1 to 8 are fixed to the arrays of the example illustrated in FIG. 11.

However, the processing circuit 100 may include the prohibition setting unit 137 capable of selecting any of a plurality of settings including the first setting and the second setting. In this way, the plurality of settings can be appropriately switched in the processing circuit 100. For example, the circuit device 10 may include an interface that accepts user input. The interface is one or a plurality of terminals capable of switching between a high level and a low level, for example. The prohibition setting unit 137 accepts the user input via the interface, and switches the prohibition setting based on the user input.

For example, the prohibition setting memory 135 illustrated in FIG. 8 stores a matrix T1 corresponding to the first setting and a matrix T2 corresponding to the second setting. T1 corresponds to the above equation (5), and T2 corresponds to the above equation (1). The prohibition setting unit 137 performs a process for reading either T1 or T2 from the prohibition setting memory 135 based on the user input. The information stored in the prohibition setting memory 135 may be the candidate arrays 1 to 8, or may be other information capable of specifying the prohibition component.

The processing circuit 100 may also include a prohibition component setting unit that sets the prohibition component of the matrix. Here, the prohibition component setting unit acquires the information specifying the prohibition setting, and performs a process for generating the initial value of the matrix T or the candidate arrays 1 to 8 in FIG. 11 based on the prohibition setting. Specifically, the prohibition setting unit 137 may include the prohibition component setting unit. Alternatively, the prohibition setting unit 137 and the prohibition component setting unit may be separately provided, and the prohibition component setting unit may set the prohibition component by acquiring information specifying the prohibition setting from the prohibition setting unit 137. For example, information specifying the position of the prohibition component is stored in the prohibition setting memory 135, and the prohibition component setting unit performs a process for generating the initial value of the matrix T or the candidate arrays 1 to 8 in FIG. 11 based on the information.

3.2 Definition of First Selection Order and Second Selection Order

In the above, the example is described in which, for example, when $P_N=(4, 8, 7, 5, 6, 3, 2, 1)^T$, the first pixel is selected fourth, and the second pixel is selected eighth. However, the definition of a vector representing the selection order is not limited thereto. For example, when $P_N$ is the above-described example, it may be defined that the fourth pixel is selected first and the eighth pixel is selected second in the first selection order.

When the first selection order is $P_N=(4, 8, 7, 5, 6, 3, 2, 1)^T$ and the prohibition setting is the second setting, the third pixel, the fourth pixel, and the fifth pixel are prohibited from being selected first in the second selection order. Similarly, the seventh pixel, the eighth pixel, and the first pixel are prohibited from being selected second.

When it is attempted to obtain $P_{N+1}$ by the operation of multiplying the matrix T by $P_N$ as in the above equation (2), the first row of the matrix T becomes (X, $\sigma_{12}$, $\sigma_{13}$, X, $\sigma_{15}$, X, $\sigma_{17}$, $\sigma_{18}$). That is, in the first selection order, the components corresponding to the third pixel, the fourth pixel, and the fifth pixel are the prohibition components, and the other components are the candidate components. Similarly for the second row and subsequent rows, the initial value of the matrix T may be set by setting prohibition components based on the first selection order. However, in this case, depending on the specific content of the first selection order, the initial value of the matrix T changes. Thus, the calculation unit 131 may set the second selection order by rearranging the row components of T shown in the above equation (1) in accordance with the first selection order.

For example, the first row of the matrix T is used as information for determining the pixel to be read first in the second selection order. When $\sigma_{1q}$ in the first row is 1 and the other components are 0, the q-th pixel is selected first in the second selection order. As described above, when prohibiting the third pixel, the fourth pixel, and the fifth pixel from being selected first in the second selection order, the first row of the matrix T is ($\sigma_{11}$, $\sigma_{12}$, X, X, X, $\sigma_{16}$, $\sigma_{17}$, $\sigma_{18}$). This combination of the prohibition components corresponds to the fourth row of the matrix T shown in the above equation (1). Similarly, when prohibiting the seventh pixel, the eighth pixel, and the first pixel from being selected second, the second row of the matrix T may be (X, $\sigma_{22}$, $\sigma_{23}$, $\sigma_{24}$, $\sigma_{25}$, $\sigma_{26}$, X, X). This combination of the prohibition components corresponds to the eighth row of the matrix T shown in the above equation (1).

Figure 15:
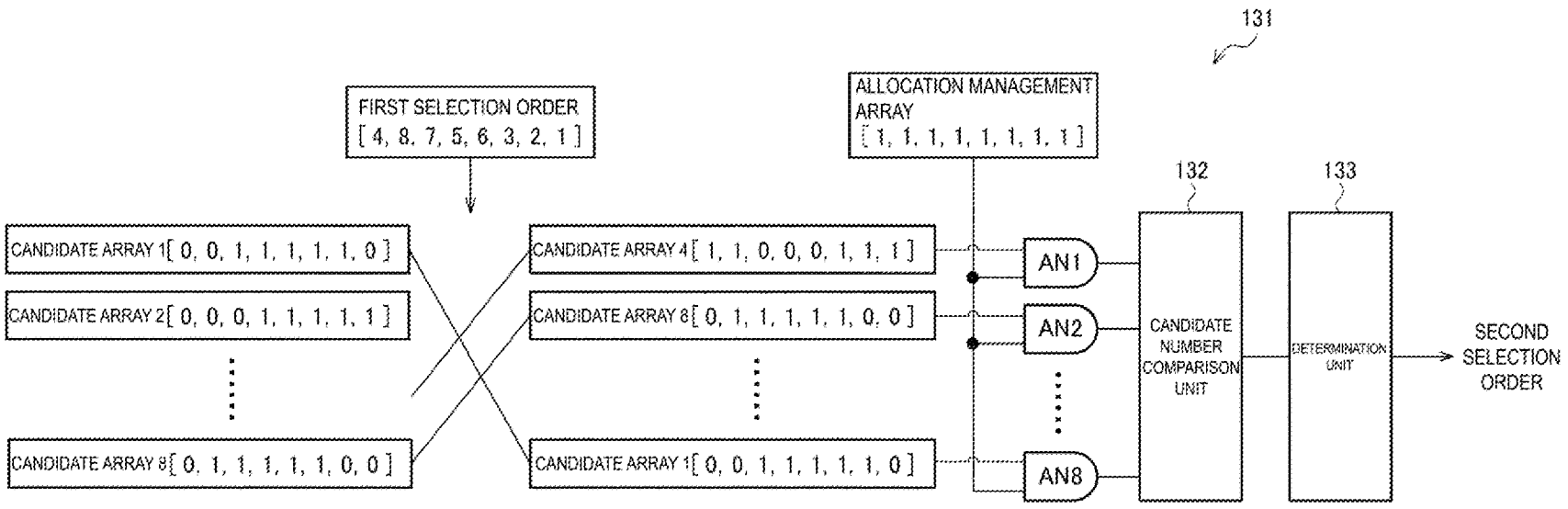
FIG. 15 is a schematic diagram illustrating a method for rearranging candidate arrays.

FIG. 15 is a schematic diagram illustrating a process of the calculation unit 131 according to the exemplary modified example. Note that, in FIGS. 15 and 16, the candidate arrays 3 to 7 are omitted for ease of explanation. As illustrated in FIG. 15, candidate arrays 1 to 8 corresponding to the initial value of the matrix T are the same as those in FIG. 11. That is, the initial value of the matrix T can be made common regardless of the first selection order. Then, the calculation unit 131 rearranges the candidate arrays 1 to 8 based on the first selection order. Note that the calculation unit 131 may separately prepare the n×n flip-flops, and may hold the rearranged candidate arrays separately from the initial candidate arrays 1 to 8. However, the calculation unit 131 does not need to physically replace the candidate arrays, and may hold only a correspondence relationship such that, for example, the candidate array 4 corresponds to the first row. Note that since the configurations of the AND circuits AN1 to AN8, the candidate number comparison unit 132, and the determination unit 133 and the processing order are the same as those in FIGS. 11 to 13, detailed descriptions thereof will be omitted.

Figure 16:
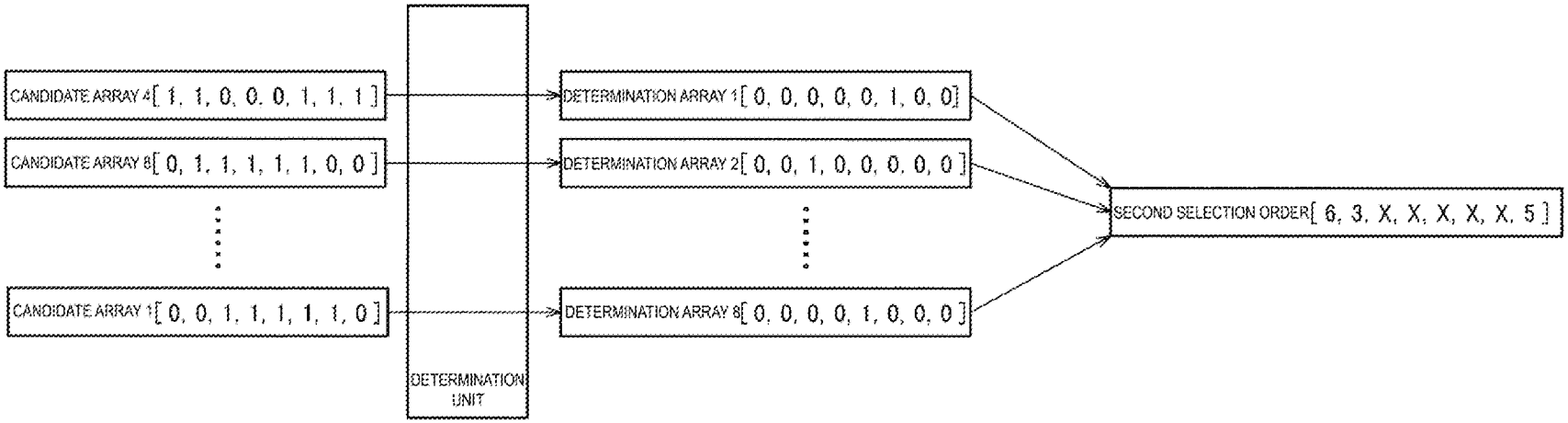
FIG. 16 is a schematic diagram illustrating a setting process for a second selection order.

FIG. 16 is a diagram illustrating a state in which the process for all eight candidate arrays has been completed and the determination arrays 1 to 8 have been obtained. As described above, here, the determination array 1 is obtained based on the candidate array 4. Similarly, the determination array 2 is obtained based on the candidate array 8, and the determination array 8 is obtained based on the candidate array 1.

The first pixel to be selected in the second selection order is determined based on the determination array 1. Specifically, since the determination array 1 is [0, 0, 0, 0, 0, 1, 0, 0], the first pixel to be selected in the second selection order is the sixth pixel. Similarly, the third pixel is selected second, and the fifth pixel is selected eighth. In other words, in the exemplary modified example illustrated in FIGS. 15 and 16, since the second selection order can be set directly from the determination array, the selection order setting unit 134 illustrated in FIG. 11 can be omitted.

Note that, in the above, the example has been described in which, first, the rows of the matrix T are rearranged based on the first selection order, and then the process of determining the matrix satisfying the conditions (A) to (C) described above is performed with the value of the rearranged matrix as the initial value. However, first, the process of determining the matrix T satisfying the above conditions (A) to (C) using the above equation (1) as the initial value may be performed, and then the process of rearranging the matrix T based on the first selection order may be performed.

Figure 17:
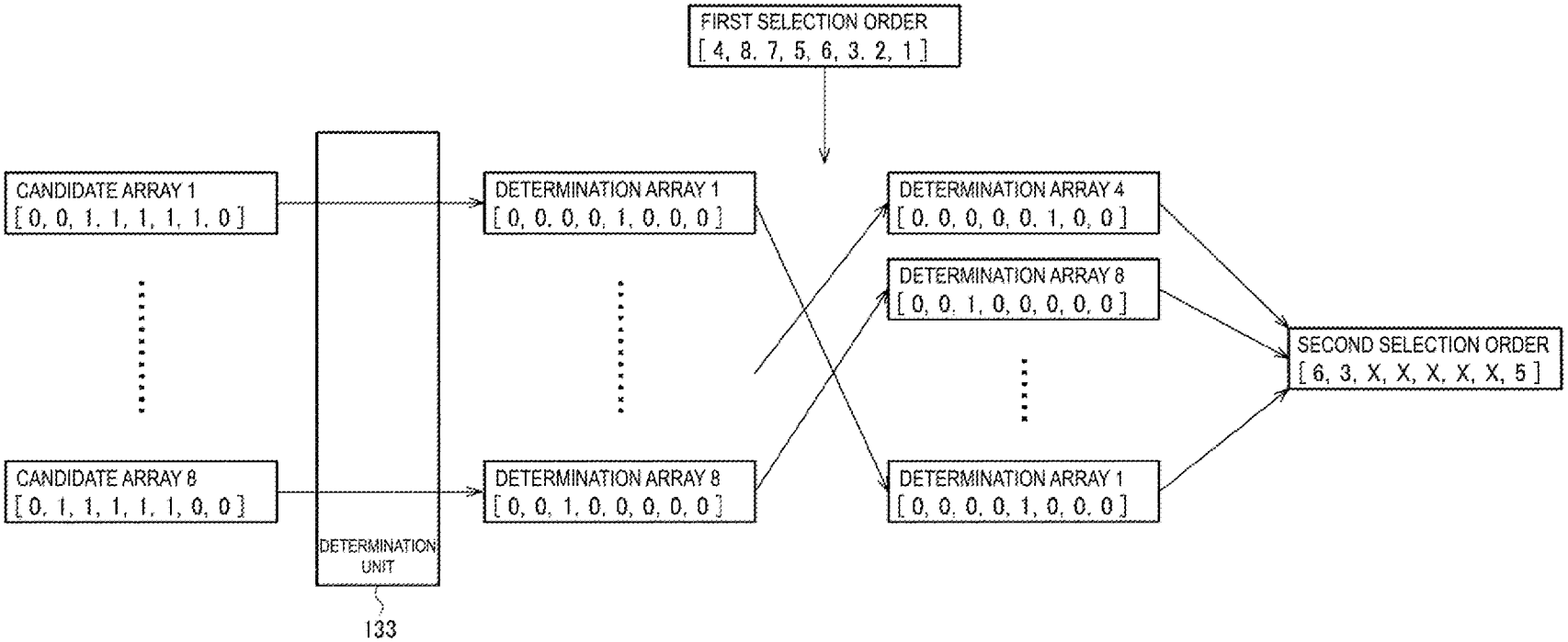
FIG. 17 is a schematic diagram illustrating a setting process for a second selection order.

FIG. 17 is a diagram illustrating the process in this case. As illustrated in FIG. 17, the determination unit 133 obtains the determination arrays 1 to 8 by performing the same process as in FIGS. 11 to 13. Thereafter, the second selection order is set by rearranging the determination arrays 1 to 8 based on the first selection order. That is, in the exemplary modified example, it suffices when the correspondence relationship of which row of the original matrix T is the information that determines which component in the second selection order is determined based on the first selection order, and various modifications are possible for the specific processing procedure.

As described above, the processing circuit 100 according to the exemplary embodiment obtains the second selection order using the first selection order and the matrix. Here, "using the first selection order and the matrix" may represent the multiplication of the first selection order and the matrix as in the above equation (2), or may represent the process for exchanging the matrix components based on the first selection order as described in the exemplary modified example.

3.3 Definition of Candidate Array and Determination Array

In the above, the example has been described in which each of the determination arrays 1 to 8 is 8-bit data. However, the determination array is an array in which any one of the eight bits is 1 and the other seven bits are 0. Thus, multi-bit data with one component may be used as the determination array. Note that, since there is only one component, it is not an array in a strict sense, but in the following, for convenience of explanation, the information of one component corresponding to the determination array is also referred to as the determination array.

For example, since determination array 2 illustrated in FIG. 12 is [0, 0, 0, 1, 0, 0, 0, 0], the determination array 2 can be represented by the data indicating that "fourth bit in eight bits is 1". For example, the determination array 2 may be 4-bit data "0100" representing the decimal number four. Alternatively, when the eight bits of the determination array are considered to be zeroth to seventh bits, the above determination array 2 may be 3-bit data "011".

Also, the candidate array is not limited to 8-bit data. For example, the candidate arrays 1 to 8 may include five components, and each component may be multi-bit data. For example, the candidate array 1 includes five components [3, 4, 5, 6, 7], whereby, first, second, and eighth components are specified as prohibition components and the third to seventh components are specified as candidate components. In a broad sense, the candidate array is an array that includes the number of components obtained by subtracting the number of prohibition components from n. The determination array in this case may be information in which the value of any one of the five components of the candidate array is maintained and the other four components are set to 0. Alternatively, the determination array may be information represented by one component as described above.

3.4 Process in Units of Columns

The process for determining the second selection order in the exemplary embodiment is the process for determining the matrix T to satisfy the conditions (A) to (C). In the method of the exemplary embodiment, it is only necessary to determine such a matrix T, and the determination procedure can be modified. Specifically, the matrix T may be processed in units of columns.

Specifically, the processing circuit 100 performs a process of selecting any of the columns included in the matrix in step S102 in FIG. 9. Then, among the components included in the q-th column of the matrix (q is an integer of 1 to n), when components other than the prohibition component are used as candidate components, in step S103 in FIG. 9, the processing circuit 100 selects one component from the candidate components in q-th column using the random number information. Then, when the selected candidate component is in the p-th row, in step S104, the processing circuit 100 sets the components in the p-th row of the undetermined columns, which are the columns in which the selection of the candidate component based on the random number information of the matrix has not been performed, as the prohibition components. Note that, in the q-th column, the unselected candidate components are also set to 0.

Even when the process is performed in units of columns in this manner, it is possible to determine the matrix T satisfying the conditions (A) to (C).

When the matrix T is determined, the second selection order can be set by the above-described process. In other words, the processing circuit 100 performs the process of selecting one component from the candidate components using the random number information for the first to n-th columns, and determines the second selection order based on the matrix after the processing and the first selection order. For example, the second selection order can be set by multiplying the determined matrix T by the $P_N$ corresponding to the first selection order.

Also in the modified examples described using FIGS. 15 to 17, the calculation unit 131 performs the process of determining the specific matrix T by determining the values of the candidate components so as to satisfy the conditions (A) to (C) for the matrix of the above equation (1) or the matrix obtained by rearranging the above equation (1) according to the first selection order. The matrix determination process at that time is not prevented from being executed in units of columns.

Note that the processing circuit 100 selects one component from the candidate components using the random number information, for the column including fewest candidate components among the undetermined columns. In other words, the calculation unit 131 selects the column including fewest candidates in the column determination process of step S102. In this way, the matrix satisfying the conditions can be reliably determined.

In addition, when determining the one matrix T, the process in units of rows and process in units of columns may be combined. For example, rows and columns may be selected alternately, such as selecting a row in step S102 for the first time and selecting a column in step S102 for the second time. In addition, various modifications can be made to the designation of rows or columns.

Further, in the above, although the example has been described in which $P_N$ and $P_{N+1}$ representing the first selection order and the second selection order are column vectors, $P_N$ and $P_{N+1}$ may be row vectors. The q-th column of the row vector is information specifying in what order the q-th pixel is selected, for example. Then, $P_{N+1}$ may be determined by the following equation (7) based on $P_N$ and the matrix T. The q-th column of the matrix T is information for selecting the selection order of the q-th pixel in the second selection order.

[Mathematical Equation 7]

$$P_{N+1}=P_N \times T \tag{7}$$

The same applies to this case as long as the matrix T satisfying the above conditions (A) to (C) can be determined, and the determination process for the matrix T may be performed by designating a row or a column.

In the above, the example in which the first selection order is the selection order immediately before the second selection order has been described. In other words, the second selection order is set based on the previous selection order, or in a narrow sense, the selection order in the previous horizontal scanning period. However, the method of the exemplary embodiment is not limited thereto. For example, the first selection order may be a selection order that is k lines (k is an integer of two or greater) before the second selection order. Alternatively, the first selection order may be a selection order one frame before the second selection order.

4. ELECTRO-OPTICAL DEVICE AND ELECTRONIC APPARATUS

The method of the exemplary embodiment can be applied to an electro-optical device 30 including the circuit device 10 and the electro-optical panel 20 described above. The method of the exemplary embodiment can also be applied to an electronic apparatus 300 including the circuit device 10 described above.

Figure 18:
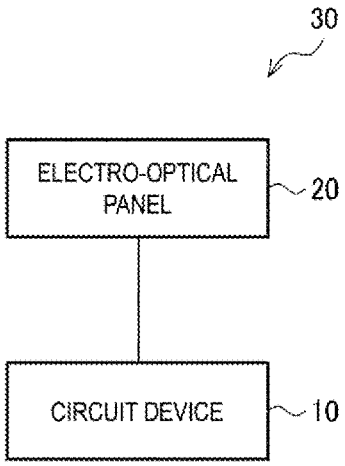
FIG. 18 is a configuration example of an electro-optical device.

FIG. 18 is a configuration example of the electro-optical device 30 including the circuit device 10 which is the display driver. The electro-optical device 30 includes the circuit device 10 and the electro-optical panel 20.

The electro-optical panel 20 is, for example, an active matrix liquid crystal display panel as described above. For example, the circuit device 10 is mounted on a flexible substrate, the flexible substrate is coupled to the electro-optical panel 20, and the data voltage output terminals TD1 to TDt of the circuit device 10 and the data voltage input terminals TI1 to TIt of the electro-optical panel 20 are coupled via wiring formed on the flexible substrate. Alternatively, the circuit device 10 may be mounted on a rigid substrate, the rigid substrate and the electro-optical panel 20 may be coupled via a flexible substrate, and the data voltage output terminals TD1 to TDt of the circuit device 10 and the data voltage input terminals TI1 to TIt of the electro-optical panel 20 may be coupled via wiring formed on the rigid substrate and the flexible substrate.

Figure 19:
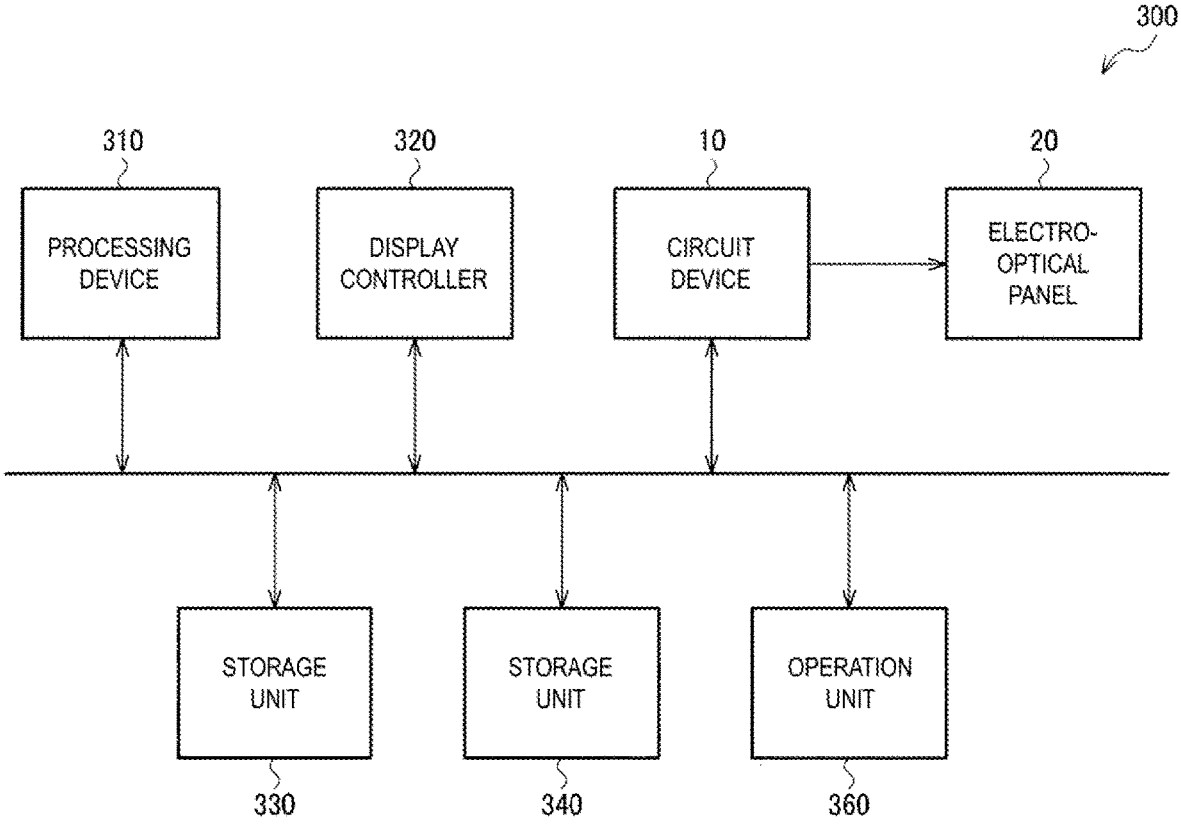
FIG. 19 is a configuration example of an electronic apparatus.

FIG. 19 is a configuration example of the electronic apparatus 300 including the circuit device 10. The electronic apparatus 300 includes a processing device 310, a display controller 320, the circuit device 10, the electro-optical panel 20, a storage unit 330, a communication unit 340, and an operation unit 360. The storage unit 330 is also called a storage device or a memory. The communication unit 340 is also called a communication circuit or a communication device. The operation unit 360 is also called an operation device. Specific examples of the electronic apparatus 300 may include various electronic apparatuses provided with display devices, such as a projector, a head-mounted display, a mobile information terminal, a vehicle-mounted device, a portable game terminal, and an information processing device. The vehicle-mounted device is, for example, a meter panel, a car navigation system, or the like.

The operation unit 360 is a user interface for various types of operation by a user. For example, the operating unit 360 is a button, a mouse, a keyboard, a touch panel mounted on the electro-optical panel 20, or the like. The communication unit 340 is a data interface used for inputting and outputting image data and control data. The communication unit 340 is, for example, a wireless communication interface such as a wireless LAN interface or a near field communication interface, or a wired communication interface such as a wired LAN interface or a universal serial bus (USB) interface. The storage unit 330, for example, stores data input from the communication unit 340 or functions as a working memory for the processing device 310. The storage unit 330 is, for example, a memory such as a RAM or a ROM, a magnetic storage device such as a hard disk drive (HDD), or an optical storage device such as a CD drive or a DVD drive. The display controller 320 processes image data inputted from the communication unit 340 or stored in the storage unit 330, and transfers the processed image data to the circuit device 10. The circuit device 10 displays an image on the electro-optical panel 20 based on the image data transferred from the display controller 320. The processing device 310 carries out control processing for the electronic apparatus 300, various types of signal processing, and the like. The processing device 310 is, for example, a processor such as a central processing unit (CPU) or micro-processing unit (MPU), or an ASIC. When the electronic apparatus 300 is a projector, the electronic apparatus 300 may further include a light source and an optical system.

Although the exemplary embodiment has been described in detail above, those skilled in the art will easily understand that many modified examples can be made without substantially departing from novel items and effects of the exemplary embodiment. All such modified examples are thus included in the scope of the disclosure. For example, terms in the descriptions or drawings given even once along with different terms having identical or broader meanings can be replaced with those different terms in all parts of the descriptions or drawings. All combinations of the embodiment and modified examples are also included within the scope of the disclosure. Further, the configurations, operations, and the like of the circuit device, the electro-optical device, the electronic apparatus, and the like are not limited to those described in the embodiment, and various modified examples thereof are possible.

What is claimed is:

1. A circuit device configured to drive an electro-optical panel including a demultiplexer provided between a first to n-th data lines and a data signal supply line, n being an integer of three or greater, the circuit device comprising:

a data line driving circuit configured to output a data signal to the data signal supply line; and a processing circuit configured to set a selection order, by the demultiplexer, of the first to n-th data lines, wherein when an i-th data line is selected j-th, in a first selection order that is the selection order as currently set of the first to n-th data lines with i being an integer of 1 to n and j being an integer of 1 to n, the processing circuit sets a second selection order using random number information so as to prohibit the i-th data line from being selected j-th in the second selection order, the second selection order being the selection order set as a next selection order of the first to n-th data lines.

2. The circuit device according to claim 1, wherein the processing circuit sets the second selection order so as to prohibit an (i−1)-th data line and an (i+1)-th data line from being selected j-th in the second selection order, i being an integer of 2 to n−1.

3. The circuit device according to claim 2, wherein the processing circuit includes a prohibition setting unit configured to select any one of a plurality of settings including a first setting that prohibits the i-th data line from being selected j-th, and does not prohibit the (i−1)-th data line and the (i+1)-th data line from being selected j-th in the second selection order, and a second setting that prohibits the i-th data line, the (i−1)-th data line, and the (i+1)-th data line from being selected j-th in the second selection order.

4. The circuit device according to claim 1, wherein the processing circuit determines the second selection order based on a matrix and the first selection order, the matrix including a prohibition component that prohibits the i-th data line from being selected j-th in the second selection order.

5. The circuit device according to claim 4, wherein the prohibition component is a diagonal component of the matrix.

6. The circuit device according to claim 4, wherein when a component of a p-th row and a q-th column of the matrix is expressed as $a_{pq}$ with p and q being integers of 1 to n, the prohibition components are $a_{pp}$, $a_{p(p-1)}$), and $a_{p(p+1)}$).

7. The circuit device according to claim 5, wherein the processing circuit includes a prohibition component setting unit that sets the prohibition component of the matrix.

8. The circuit device according to claim 4, wherein when components other than the prohibition component, among the components included in the p-th row of the matrix, are candidate components with p being an integer of 1 to n, the processing circuit selects one component from the candidate components in the p-th row using the random number information, and determines a p-th component of the second selection order based on the p-th row after the selection and the first selection order.

9. The circuit device according to claim 8, wherein when the candidate component selected from the candidate components in the p-th row using the random number information is in a q-th column with q being an integer of 1 to n, the processing circuit sets, as the prohibition component, a component in the q-th column of an undetermined row that is a row in which the candidate component is not selected based on the random number information in the matrix.

10. The circuit device according to claim 9, wherein the processing circuit selects one component from the candidate components using the random number information, for a row including fewest candidate components among the undetermined rows.

11. The circuit device according to claim 4, wherein when components other than the prohibition component, among components included in a q-th column of the matrix, are candidate components with q being an integer of 1 to n, the processing circuit selects one component from the candidate components in the q-th column using the random number information, and when the selected candidate component is in a p-th row with p being an integer of 1 to n, the processing circuit sets, as the prohibition component, a component in the p-th row of an undetermined column that is a column in which the candidate component is not selected based on the random number information in the matrix.

12. The circuit device according to claim 11, wherein the processing circuit selects one component from the candidate components using the random number information, for a column including fewest candidate components among the undetermined columns.

13. The circuit device according to claim 12, wherein the processing circuit performs processing of selecting, for a first to n-th columns, one component from the candidate components using the random number information, and determines the second selection order based on the matrix after the processing and the first selection order.

14. An electro-optical device comprising:

an electro-optical panel including a demultiplexer provided between a first to n-th data lines and a data signal supply line, n being an integer of three or greater; and a circuit device including a data line driving circuit configured to output a data signal to the data signal supply line; and a processing circuit configured to set a selection order, by the demultiplexer, of the first to n-th data lines, wherein when an i-th data line is selected j-th, in a first selection order that is the selection order as currently set of the first to n-th data lines with i being an integer of 1 to n and j being an integer of 1 to n, the processing circuit sets a second selection order using random number information so as to prohibit the i-th data line from being selected j-th in the second selection order, the second selection order being the selection order set as a next selection order of the first to n-th data lines.

15. An electronic apparatus comprising:

a circuit device configured to drive an electro-optical panel including a demultiplexer provided between a first to n-th data lines and a data signal supply line, n being an integer of three or greater, the circuit device including:

a data line driving circuit configured to output a data signal to the data signal supply line; and a processing circuit configured to set a selection order, by the demultiplexer, of the first to n-th data lines, wherein when an i-th data line is selected j-th, in a first selection order that is the selection order as currently set of the first to n-th data lines with i being an integer of 1 to n and j being an integer of 1 to n, the processing circuit sets a second selection order using random number information so as to prohibit the i-th data line from being selected j-th in the second selection order, the second selection order being the selection order set as a next selection order of the first to n-th data lines.

* * * * *